US006539672B1

(12) United States Patent
Frost

(10) Patent No.: US 6,539,672 B1
(45) Date of Patent: Apr. 1, 2003

(54) TELESCOPIC SEATING SYSTEM TIER CATCH AND METHOD

(76) Inventor: Colin C. Frost, 103 Mast Rd., Dover, NH (US) 03820

( * ) Notice: Subject to any disclaimer, the term of this patent is extended or adjusted under 35 U.S.C. 154(b) by 0 days.

(21) Appl. No.: 09/952,675

(22) Filed: Sep. 13, 2001

Related U.S. Application Data

(63) Continuation of application No. 09/668,238, filed on Sep. 23, 2000, now abandoned.
(60) Provisional application No. 60/156,118, filed on Sep. 25, 1999.

(51) Int. Cl.[7] ..... E04H 3/12
(52) U.S. Cl. ..... 52/9; 52/8; 52/741.2; 292/130
(58) Field of Search ..... 52/7–9, 10, 730.1, 52/741.2; 292/130, 132, 136, 230; 160/202

(56) References Cited

U.S. PATENT DOCUMENTS 4,041,655 A 8/1977 Pari
4,155,202 A 5/1979 Hartman
4,189,876 A 2/1980 Crossman et al.
4,285,172 A 8/1981 Quigley
4,367,612 A 1/1983 Sutter
4,446,659 A 5/1984 Quigley
4,571,895 A 2/1986 Lyman, Jr.
5,069,007 A 12/1991 Paddock
5,381,873 A 1/1995 Kniefel et al.
5,459,964 A 10/1995 Doublet
5,559,411 A 9/1996 Winship
5,661,928 A 9/1997 Beu
5,787,647 A 8/1998 Dettmann et al.
5,810,430 A 9/1998 Bryjak et al.
5,819,475 A 10/1998 Momose
6,212,828 B1 4/2001 McArthur, Jr.

*Primary Examiner*—Carl D. Friedman
*Assistant Examiner*—Naoko Slack

(57) ABSTRACT

A locking system for a telescopic seating system is disclosed. The system provides a means to releasably lock adjacent telescopic seating platforms together and a means to release the locking mechanism without the need for a trip bar or other like device. The locking system employs a low profile tier catch and tier catch ramp that promotes ease of use and a reduction in the possibility of damage due to individuals walking over the locking device.

20 Claims, 23 Drawing Sheets

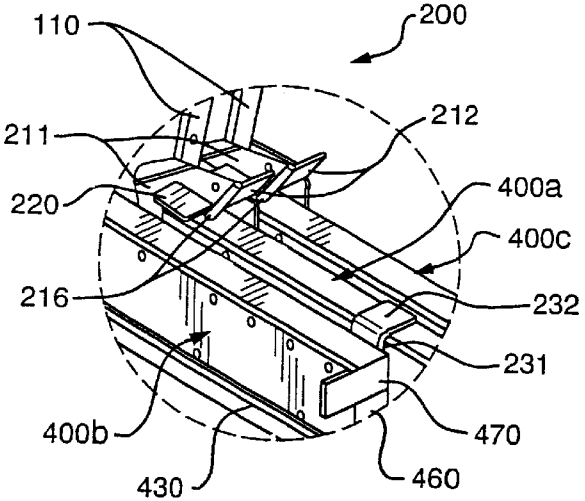
FIG. 22
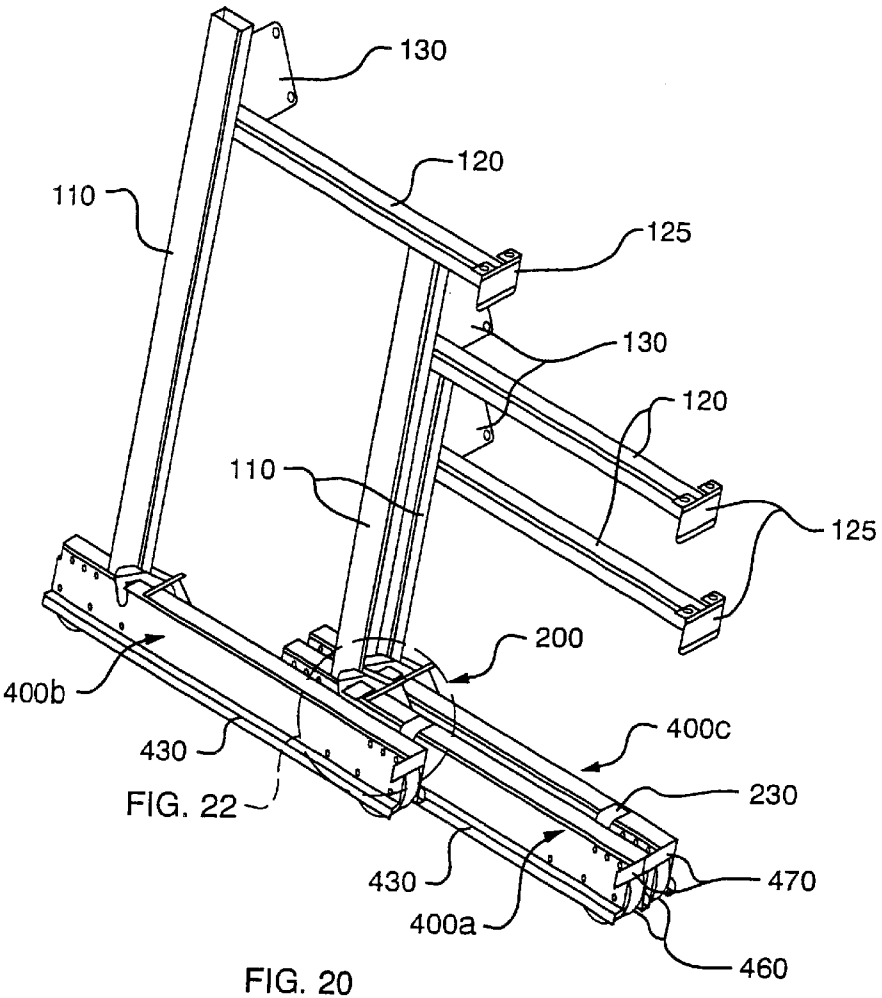
FIG. 22
FIG. 20

TELESCOPIC SEATING SYSTEM TIER CATCH AND METHOD

This application is a continuation of application Ser. No. 09/668,238, filed Sep. 23, 2000, now abandoned, which claims the benefit of Provisional application Ser. No. 60/156,118, filed Sep. 25, 1999.

FIELD OF THE INVENTION

This invention relates to telescoping seating systems. More particularly, the invention relates to tier catches for releasably locking telescopic seating platform sections.

BACKGROUND OF THE INVENTION

Conventional telescopic seating systems are compilations of individual repeatable segments known as platforms or decks. A single platform is comprised of the following components. A rear riser beam that runs transversely along the length of the deck forms the main carrying support for the platform and is situated at the back of the platform. The rear riser beam is typically a continuous rectangular piece of steel with the width of the riser having a vertical orientation relative to a substrate such as a floor on which the seating system is placed. The riser is fabricated with a rear flange that extends from a bottom end of the riser toward the front of the platform. The flange provides a surface for mounting other components of the platform.

Situated at the front of the platform is a nose beam that defines the front edge of the platform. The nose beam is typically fabricated from extruded aluminum, tube steel or shaped into a partial tube from sheet steel. The top front edge of the nose beam is radiused to provide comfortable seating conditions if no further seating components are added to the platform. Nose beams constructed from extruded aluminum or sheet steel formed into a partial tube lacks the strength of a tube steel design but is far less expensive to manufacture. There is thus a need for a nose beam that has the strength of a tube steel design but which is cost efficient relative to the sheet steel open design.

Extending toward the back of the platform from the nose beam is a front flange that provides a mounting surface for further components of the platform. The front flange can be either a separate bar of steel welded onto the nose beam or a continuation of the sheet steel that forms the main body of the nose beam. Structural steel is the material of choice for the rear riser beam and the nose beam since these components are required to withstand the application of significant loads along their lengths. Of course, any durable material that is capable of withstanding the compression and tension forces imparted onto the beams can be utilized for these components.

The rear riser beam and nose beam are connected at their ends by a pair of lateral deck supports. The deck supports can be either bolted to or welded onto the transverse riser and nose beams. The rear riser beam and nose beam are also connected by deck supports situated between the lateral deck supports that are used to provide additional support for the decking material. The length of the particular deck determines the number of deck supports needed. Additional connections between the riser and nose beams are provided by cantilever sections of columns as described below. Both deck supports and cantilevers are made from formed steel.

The combination of the deck supports, the rear flange and the front flange provide a mounting surface for decking material which forms the surface to which further seating components are attached or upon which individuals sit.

Almost invariably, plywood-based materials are used for the decking. In fact, the industry-standard 4×8 feet sheet plywood is used which in turn, sets the standard for platform depths. In the conventional application, 4×8 sheets of a multi-ply plywood product are ripped along its length to produce two 2×8 feet sections. The platform frames to which the plywood sections are attached are sized to accommodate the 2×8 sheets. Platforms are typically 26 inches deep.

To establish the height of a platform to a selected height, columns are provided, typically in pairs, which attach to the rear riser. Conventional columns for telescopic seating systems are constructed from tube steel because of the tube steel's ability to withstand the multitude of forces applied to the platform when a load is applied.

Situated at or near the top ends of the columns are cantilevers, which extend toward the front of the platform. As stated, the cantilevers provide additional connections between the riser and nose beams. Formed within the cantilevers are linear channels or races for receiving roller wheels, which are attached to the tops of the columns. The channels are adapted to receive the column wheels of a platform that is immediately below and forward of the platform of which the channel forms a part thereof. By design, the mated wheels and channels are slidingly engageable. The wheels/channel assemblies provide a means for sliding adjacent platforms into either retracted/nested states or extended/used states. The cantilevers fully support the platforms in the retracted position.

The bottom ends of the columns are attached to castor horns. The castor horns provide a mounting base for wheels, which allow for the transitional movement of a platform from a retracted position to an extended position and vice versa. The castor horns are also typically made of steel and have features, which allow for the connection of adjacent castor horns that are part of adjoining platforms such as hooks that are adapted to be received in channels. Adjacent castor horns are adapted to be capable of sliding engagement with one another and are further capable of being releasably locked together when adjacent platforms are in an extended orientation. Castor horn engagement is provided by mating surfaces that do not extend the length of the castor horns.

To counter the various compression, tension and torque forces exerted on platform segments when placed under load, cross bracing is used. The braces are configured to attach a top end of a first column at a first end of a platform to the bottom end of a second column at a second end of the platform. Multiple cross bracing members can be used depending on the specific size and set up of a series of platforms which are joined to form telescopic seating systems.

A problem encountered with conventional telescopic seating systems is the means used to lock adjacent sections together when the telescopic seating system is partially or fully extended. Prior systems incorporate a lever lock that projects above the caster horn in conjunction with a trip bar typically located on the first row. An external handle or other device has to be used to activate the trip bar. As is well known in the art, individuals that use telescopic seating systems occasionally attempt to walk under the extended platforms to facilitate ingress or egress from the particular location. When negotiating through the maze of columns and caster horns, individuals often step on the caster horn lock mechanisms, especially the long lever arms protruding vertically. Due to the fragile design of the locks, damage and lock malfunction often result. Trip bar angles, which have to be precisely set often, have to be adjusted due to abuse.

There is thus, a need for a lock system that is capable of withstanding physical abuse and maintaining full operational capability. In addition, there is desire to eliminate the trip bar which has to be precisely set to trip each lever lock at the correct time.

It is thus an object of the invention to provide a caster horn locking mechanism that eliminates the need for a trip bar and that withstands the abuse of individuals walking onto the locks without compromising the integrity or function of the lock. These and other objects and features of the invention will be understood from a review of the following description and drawings.

SUMMARY OF THE INVENTION

The invention described herein is a locking mechanism used to releasably lock adjacent platform sections together when in an extended orientation. The locking mechanism is designed to be self-engaging in that the need for a trip bar to initial telescopic seating retraction is eliminated. The locking mechanism is comprised primarily of a tier catch mounted on the outer side of a castor horn. The tier catch has a series of flanged surfaces for engaging an end guide of an adjacent castor horn to lock the castor horn to the adjacent castor and for tripping other tier catches when moving toward a nested or retracted position.

A tier catch tab is provided to act as the tripping component to trip other tier catches. Rear flanges are provided on the tier catches to allow for adjacent tier catches to nest when in an unlocked retracted position.

To promote the stability of the tier catches in a vertical unlocked position, a tier catch ramp is affixed to a castor horn side opposite that to which the tier catch is attached. The catch ramp acts as a physical support for a vertical unlocked tier catch to ensure damage is not imparted to the tier catch if a focused load, e.g., a person's foot, is placed on the tier catch in an unlocked position.

The tier catch has an additional flange on an uppermost edge that provides a means for facilitating tier catch rotation into a vertical position past adjacent cantilevered columns. These and other features of the tier catch castor horn locking system will become apparent from a reading of the following detailed description in view of the drawings appended hereto.

BRIEF DESCRIPTION OF THE DRAWINGS

FIG. 20 is a left perspective view of a plural platform support assembly in an unlocked, closing position according to one embodiment of the invention.

FIG. 22 is a top left perspective view of a castor horn lock assembly in an unlocked, closing position according to one embodiment of the invention.

DETAILED DESCRIPTION OF THE INVENTION

Figure 1:
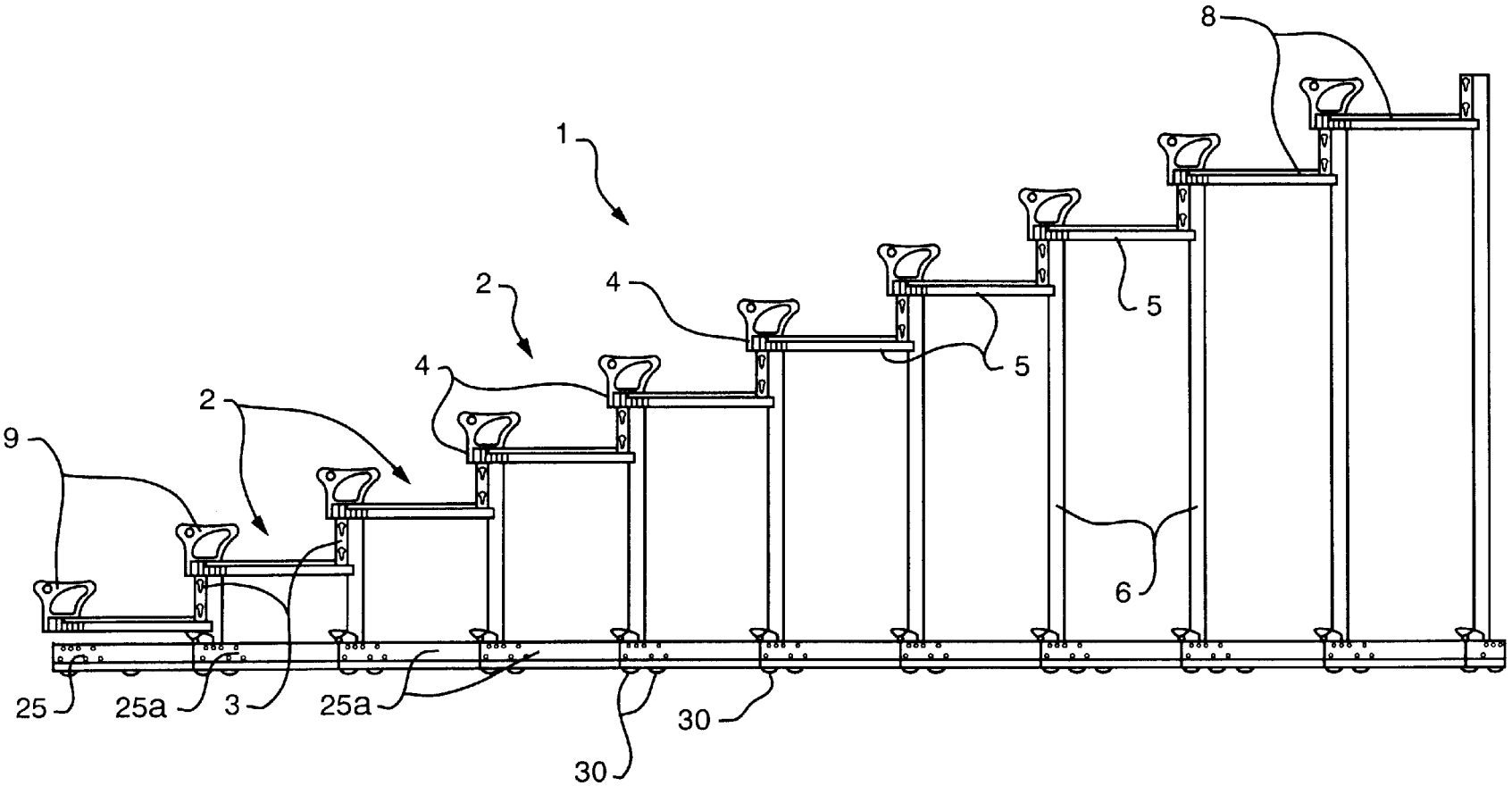
FIG. 1 is a side elevational view of a telescopic seating system in accordance with one embodiment of the invention.

At the outset, the invention is described in its broadest overall aspects with a more detailed description following. Referring to FIG. 1, a telescopic seating system, referred to generally as 1, is shown which comprises a plurality of platforms referred to generally as 2. Platforms 2 are engaged to each other such that each can slide in relation to adjacent platforms to allow for the retraction of the seating system into a nested or unused state and for the extension to an extended or operational state.

Before describing the general structure of the platforms, nomenclature will be addressed. As used herein, a first row modular unit is a platform capable of bearing loads that extends partially along the width of a telescopic seating system. A standard row unit is a platform capable of bearing loads that extends along the entire width of a telescopic seating system.

Each standard row unit, addressed simply as a platform herein below, comprises the following components. A rear riser beam 3 situated at the back of the platform and a nose beam 4 situated at the front of the platform dictate the overall length dimensions of the platforms. The rear riser beams 3 are oriented to extend upwardly on an edge to establish part of the height of the platforms and to provide mounting surfaces for other components of the platform. The nose beams 4 are preferably tubular steel structures that also have mounting surfaces for other components of the platform.

Deck stabilizers 5 and cantilevers 120 (shown in FIG. 1*a*) attach the rear riser beams 3 and nose beams 4. The deck stabilizers 5 connect the ends of the rear riser beams 3 to the ends of the nose beams 4. The cantilevers 110 are horizontal extensions of columns 6 that are provided to establish the height of the platforms 2. Each platform 2 has at least two columns 6, which set the height and carry the loads placed on the platforms. The columns 6 are biased toward the lateral edges of the platforms 2 and may be canted inwardly at their tops to better withstand load placed on the platforms as described in U.S. Pat. No. 4,041,655 to Pari.

The combination of the deck stabilizers 5, the nose beams 4 and the rear riser beams 3 provide a mounting surface for decking 8, which is typically made from plywood. The plywood decking provides a surface for mounting additional seating components such as seats 9 and provides a substrate for stepping from one platform to another.

Attached to bottom ends of the columns are castor horns 25*a*, which have channels, provided therein for receiving roller wheels 30. The castor horn/roller wheel assemblies allow for the linear movement of platforms from an extended to a retracted position and vice versa. These features are found on all platforms.

Referring now to FIGS. 1*a*–44, a low profile lock system also known as a tier catch, referred to generally as 200, is shown in various stages of locked to unlocked positions. As shown in FIGS. 4, 5, 8, 9, 12, 13, 19*a*, 19*b*, 20, 21, 24–26, 32, 34, 36 and 38, lock system 200 is shown in relation to platform frame subassemblies shown generally as 100. Platform frame subassemblies 100 comprise columns 110 which have cantilevers 120 which extend substantially perpendicular to the longitudinal axis of columns 110. Cantilevers 120 have a nose attachment plate 125 provided at a front end of cantilevers 120 for receiving a nose beam 4.

Riser attachment plates 130 for attaching a rear riser beam (not shown) are provided at or near a top end of columns 110. Columns 110 are attached to caster horns 400 which have channels 450 formed therein (as shown in FIGS. 16–19) for receiving wheels 460 which allow for the movement of platform subassemblies 100.

Attached to a front end of castor horn 400 is end stop plate 470 which arrests movement of one platform frame subassembly 100 from moving past an adjacent platform frame 100 that is positioned behind the one platform frame subassembly 100. End stop plate 470 ensures that adjacent platforms or rows will be nested in a substantially vertical orientation to optimize space utilization when in a fully retracted position.

Figure 1A:
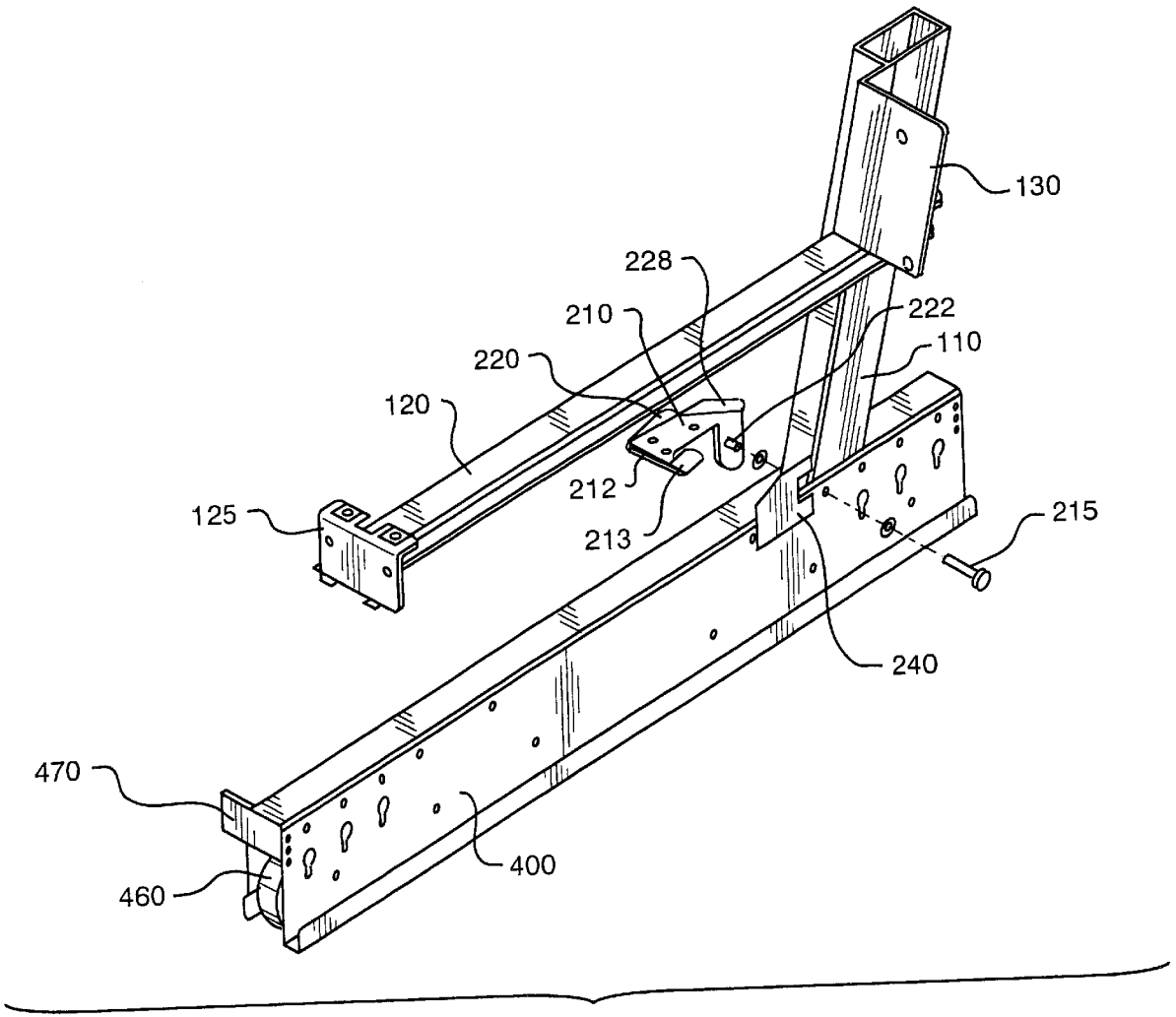
FIG. 1*a* is a side perspective view of a platform support assembly according to one embodiment of the invention.
Figure 3:
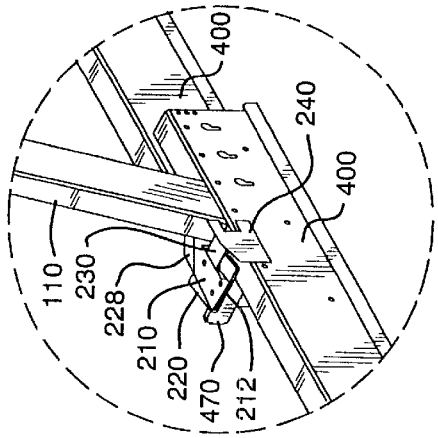
FIG. 3 is a perspective view of a castor horn lock assembly according to one embodiment of the invention.
Figure 2:
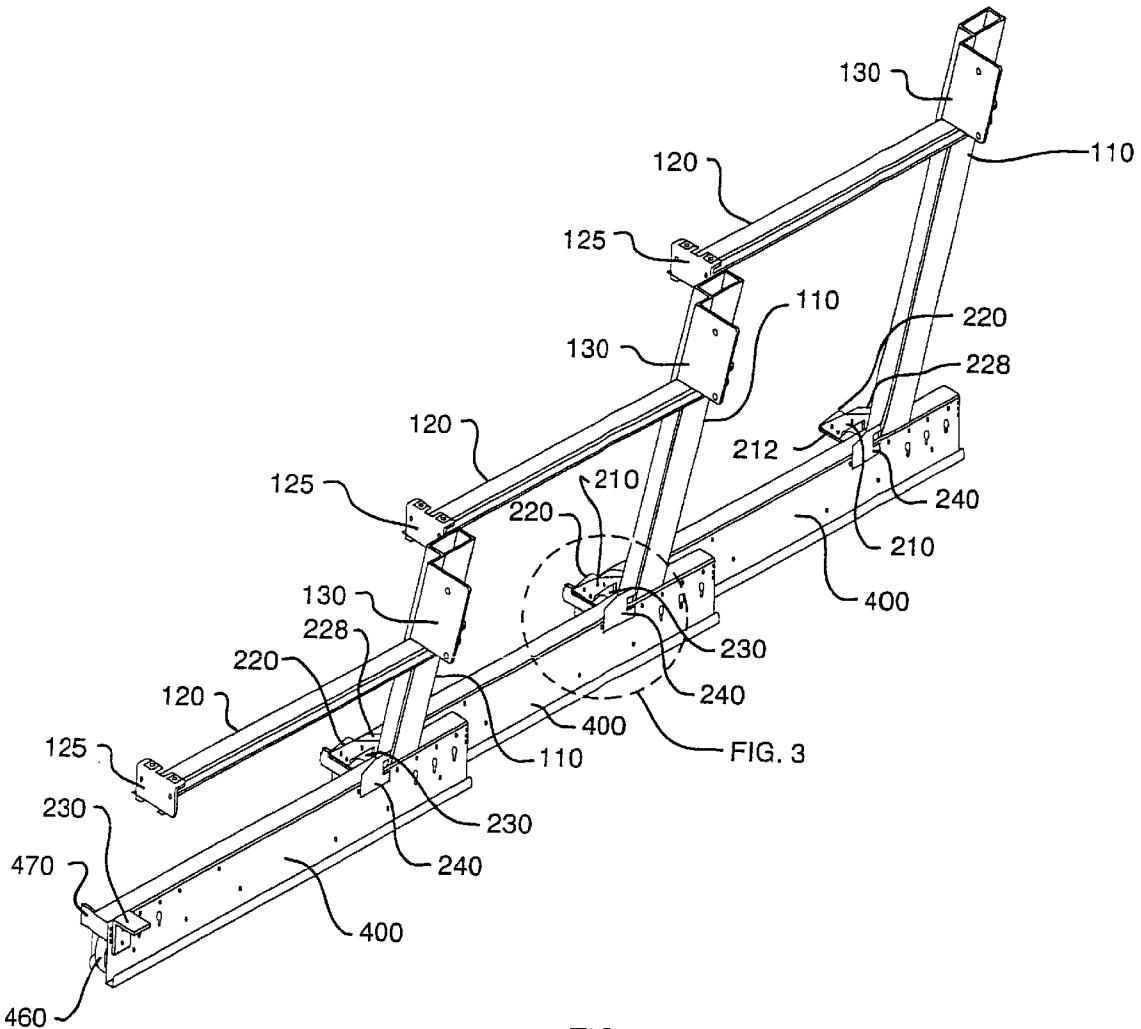
FIG. 2 is a side perspective view of a plural platform support assembly according to one embodiment of the invention.
Figure 6:
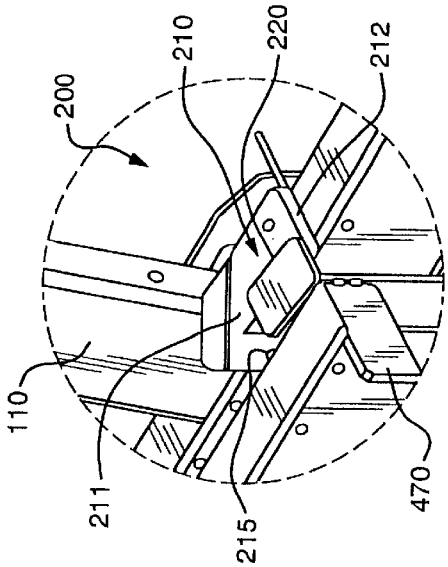
FIG. 6 is a left side perspective view of a castor horn lock assembly in a locked position according to one embodiment of the invention.
Figure 4:
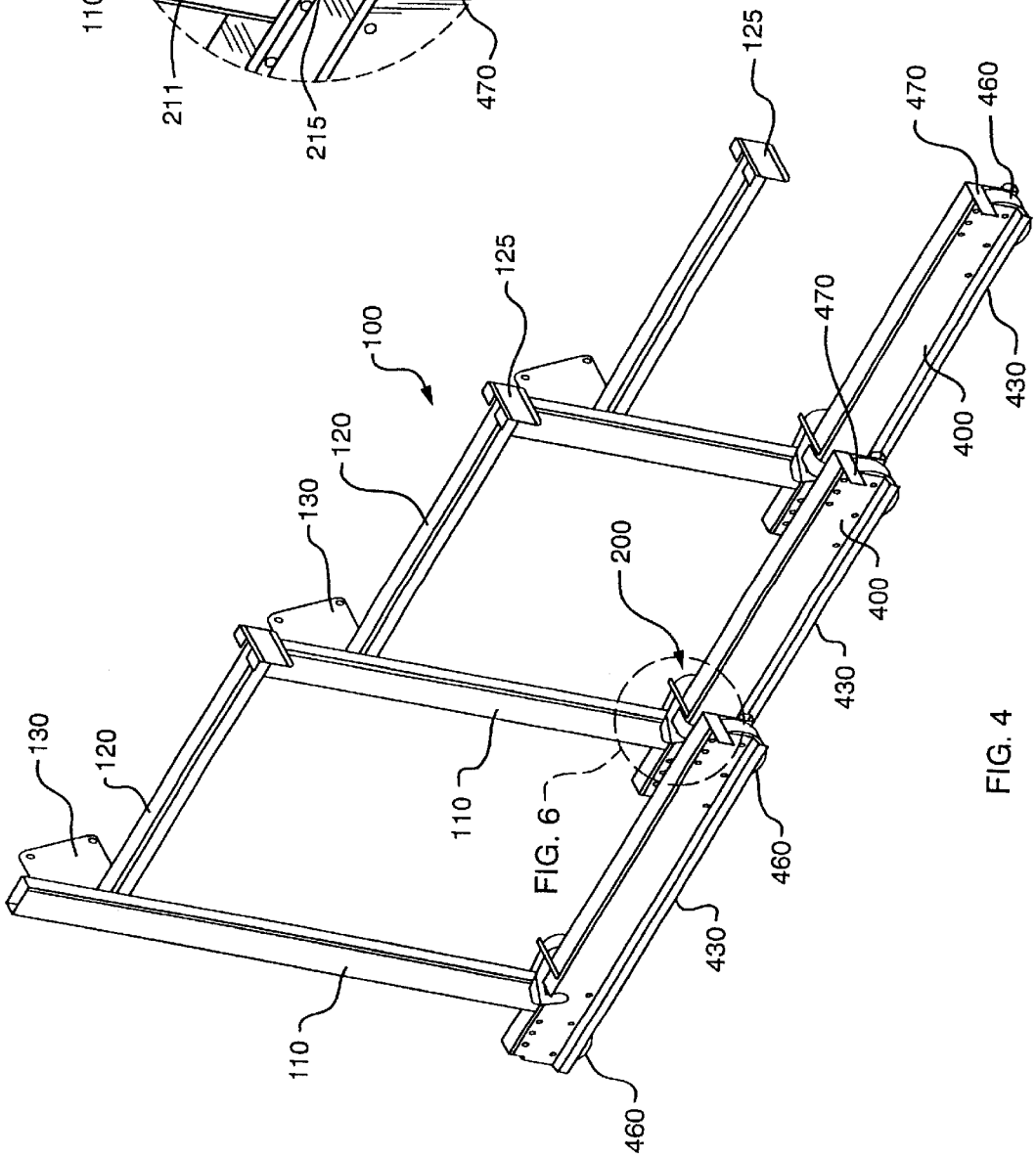
FIG. 4 is a left side perspective view of a plural platform support assembly according to one embodiment of the invention.
Figure 7:
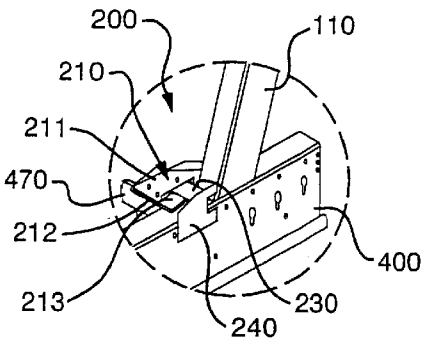
FIG. 7 is a right side perspective view of a castor horn lock assembly in a locked position according to one embodiment of the invention.
Figure 5:
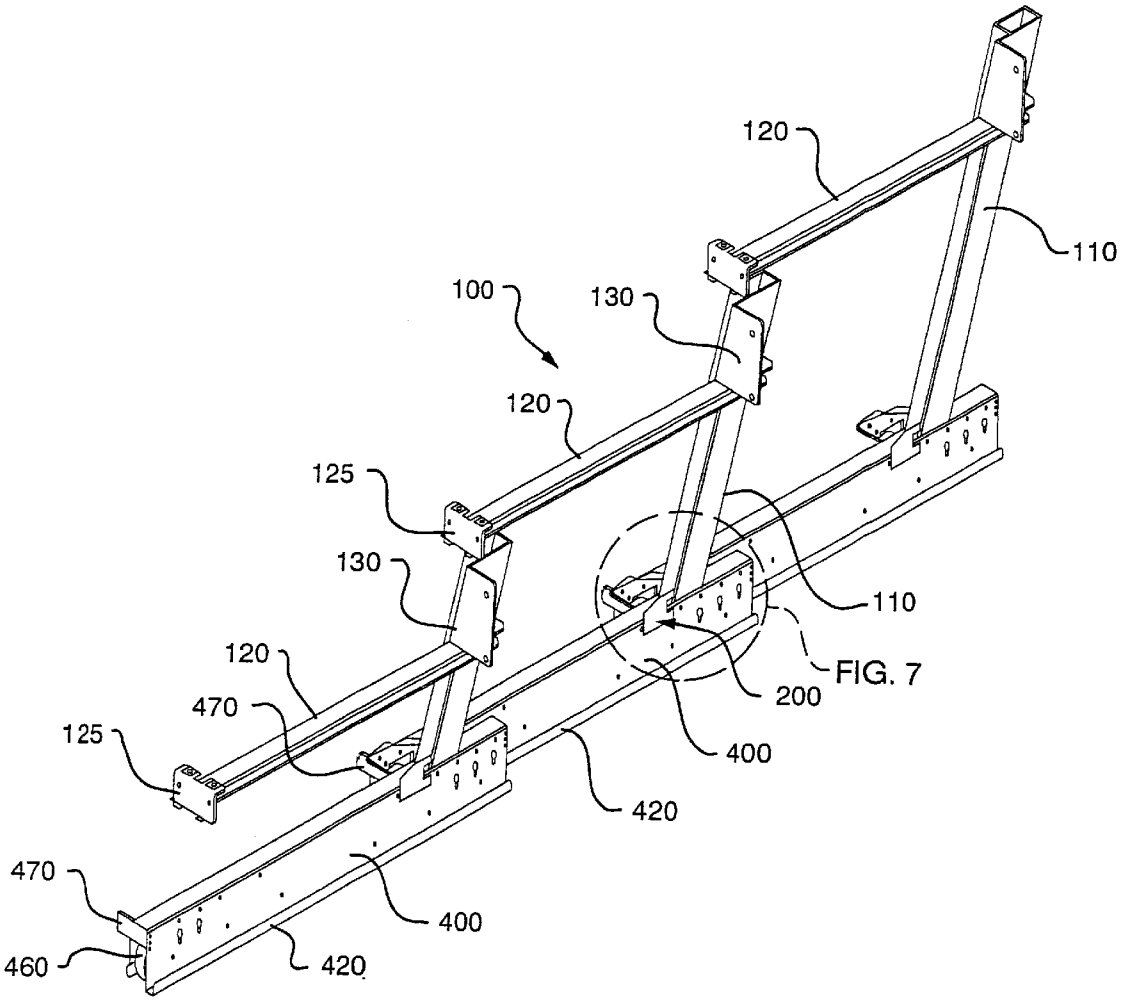
FIG. 5 is a right side perspective view of a plural platform support assembly in full extension according to one embodiment of the invention.
Figure 10:
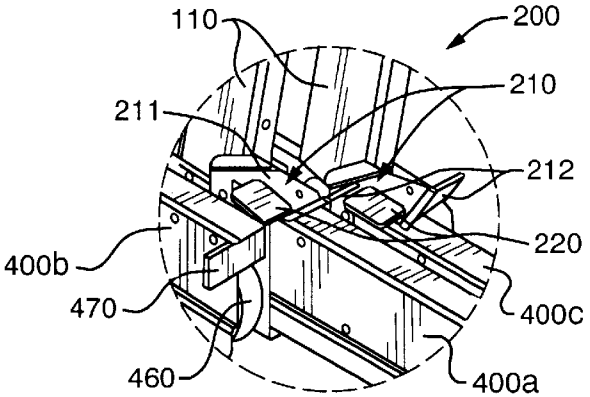
FIG. 10 is a top left perspective view of a castor horn lock assembly in a closing and unlocking position according to one embodiment of the invention.
Figure 8:
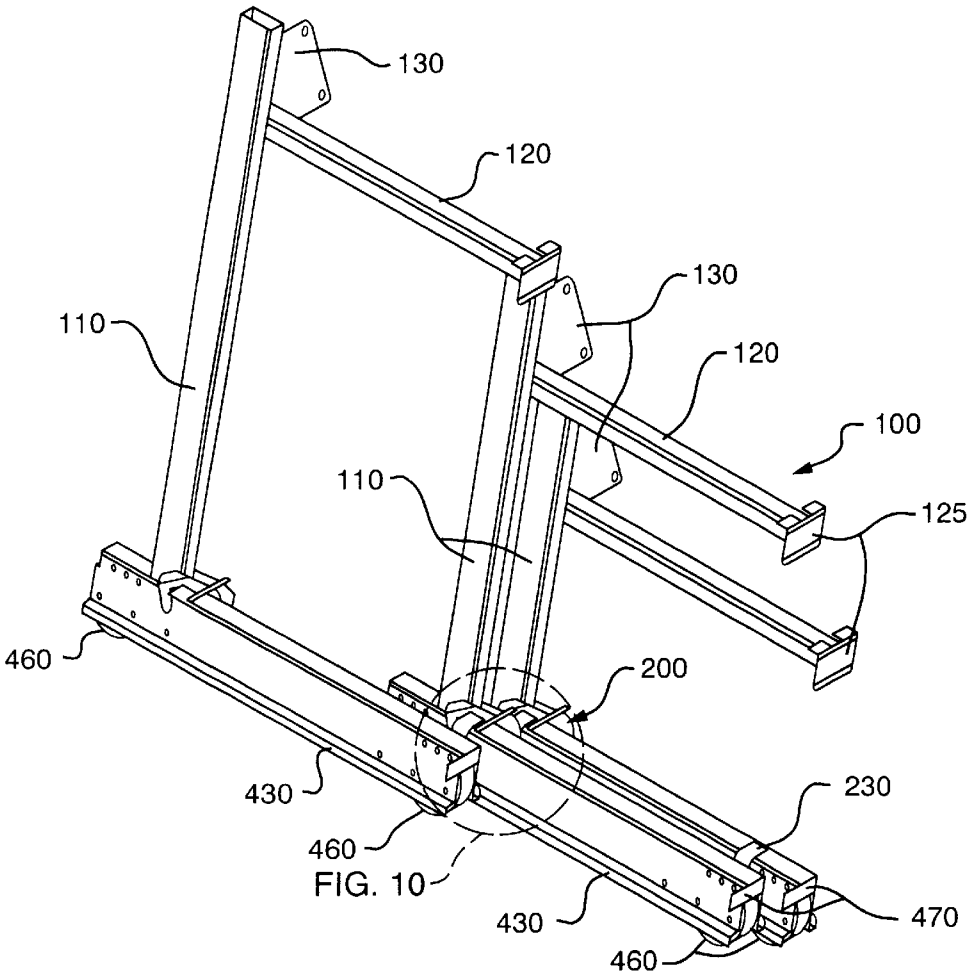
FIG. 8 is a left side perspective view of a plural platform support assembly in a semilocked position according to one embodiment of the invention.
Figure 11:
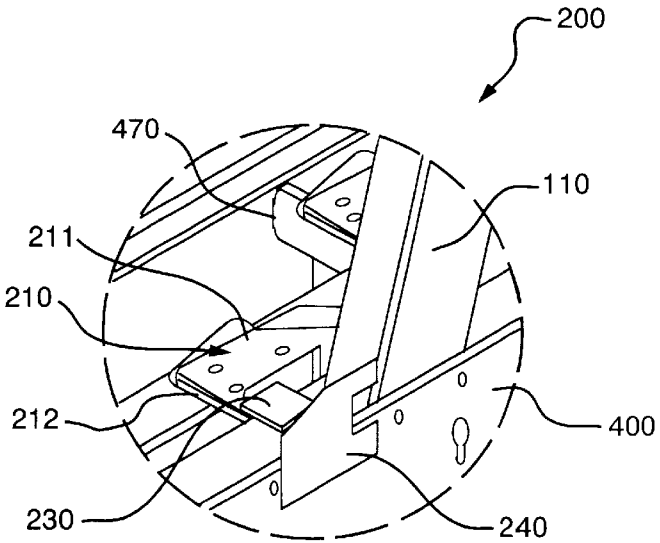
FIG. 11 is a top right perspective view of a castor horn assembly in a closing and unlocking position according to one embodiment of the invention.
Figure 9:
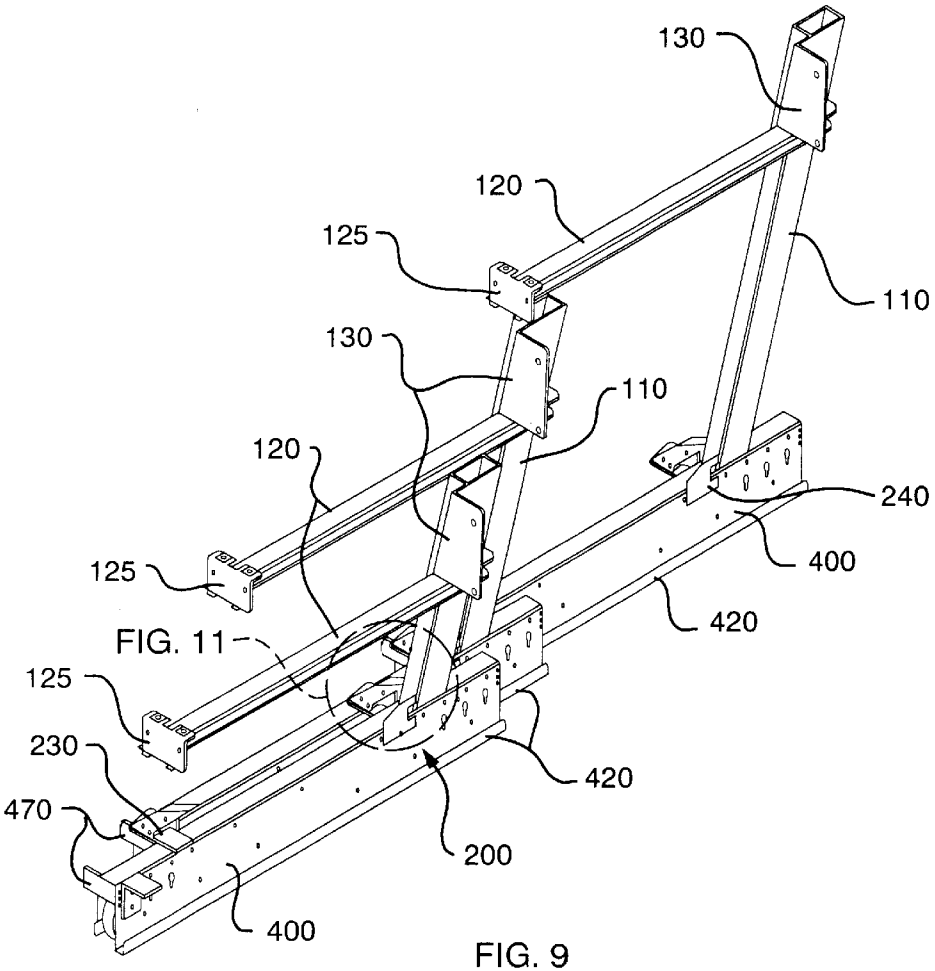
FIG. 9 is a right side perspective view of a plural platform support assembly in a closing and unlocking position according to one embodiment of the invention.
Figure 14:
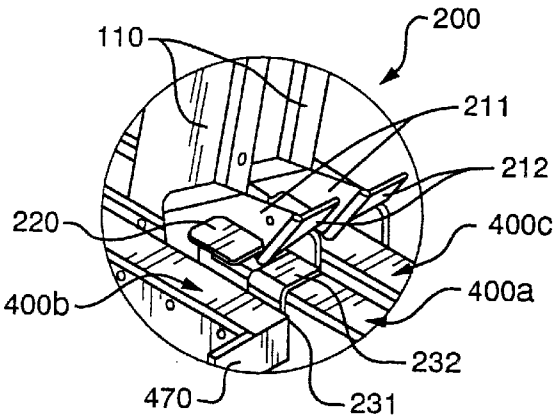
FIG. 14 is a top left perspective view of a castor horn lock assembly in an unlocking position according to one embodiment of the invention.
Figure 12:
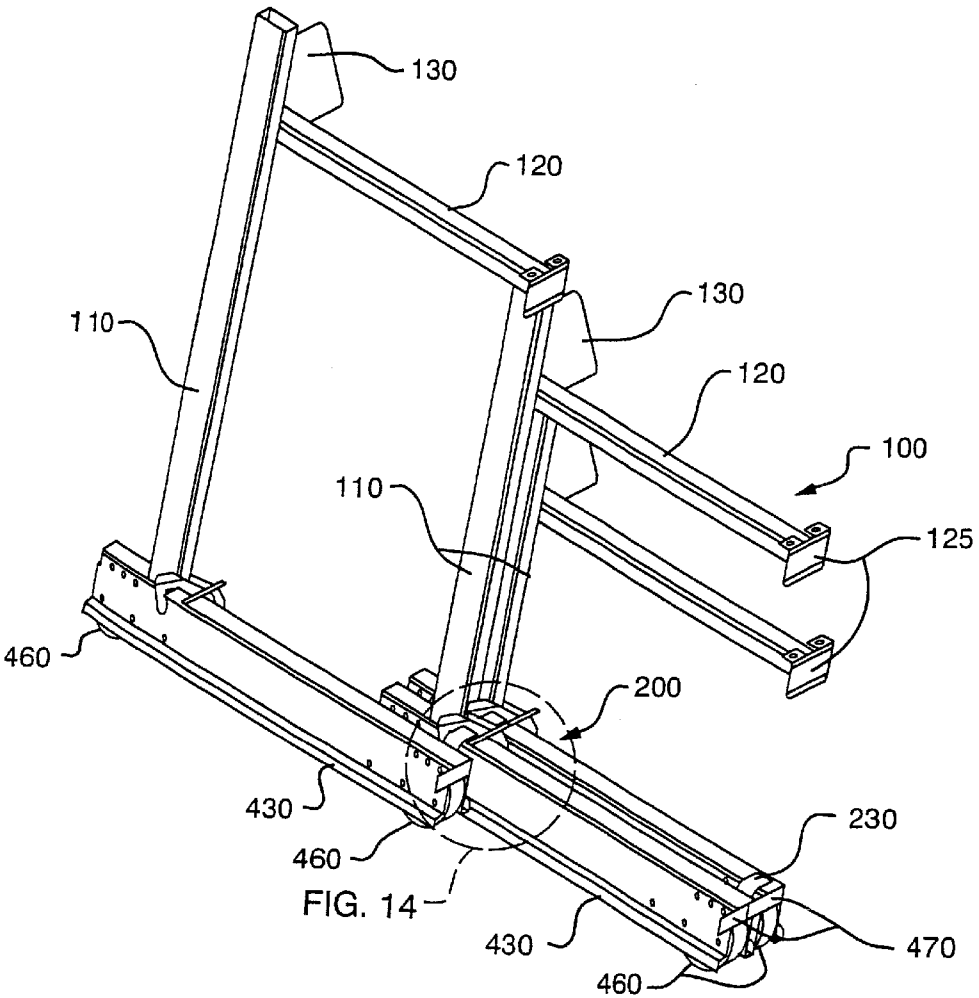
FIG. 12 is a left side perspective view of a plural platform support assembly in an unlocked and closing position according to one embodiment of the invention.
Figure 15:
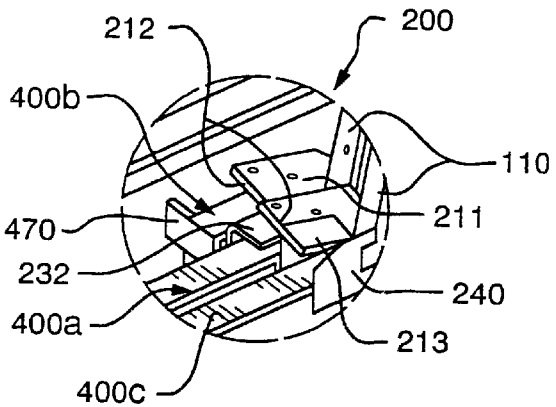
FIG. 15 is a top right perspective view of a castor horn lock assembly in an unlocking position according to one embodiment of the invention.
Figure 13:
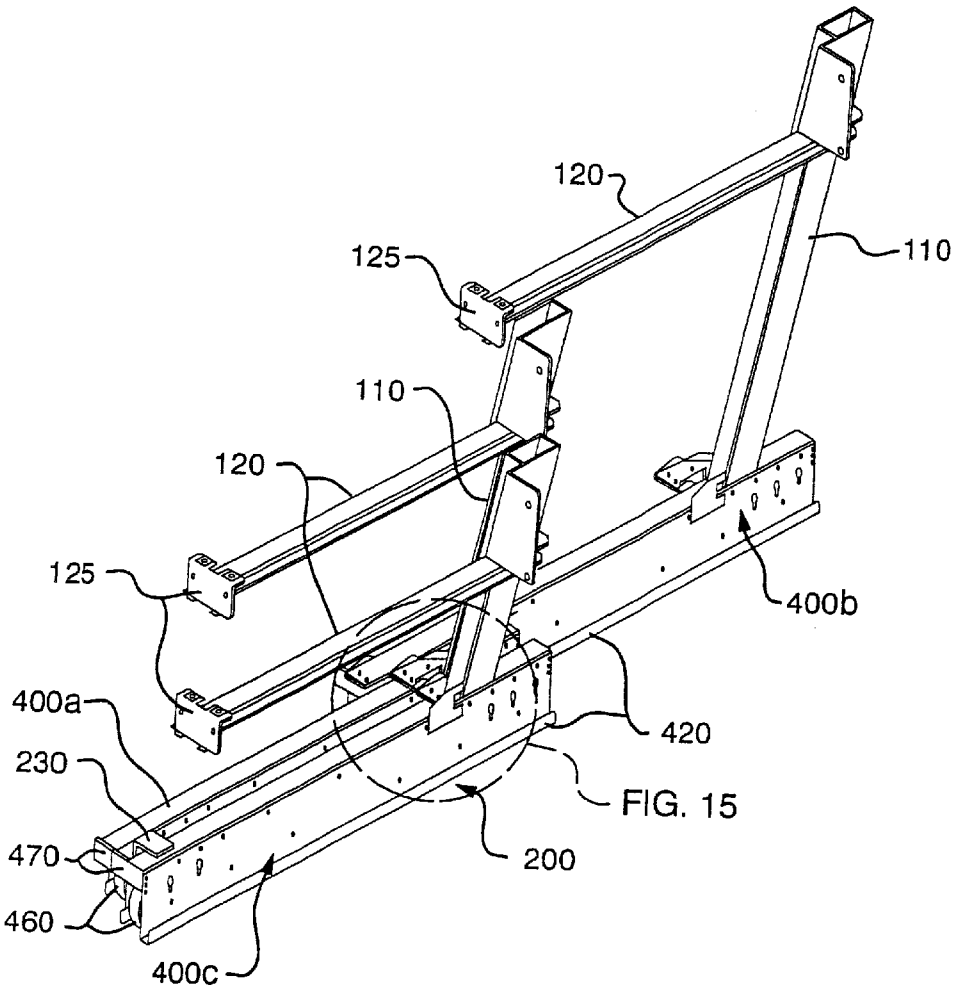
FIG. 13 is a right side perspective view of a plural platform assembly in an unlocked and closing position according to one embodiment of the invention.
Figure 16:
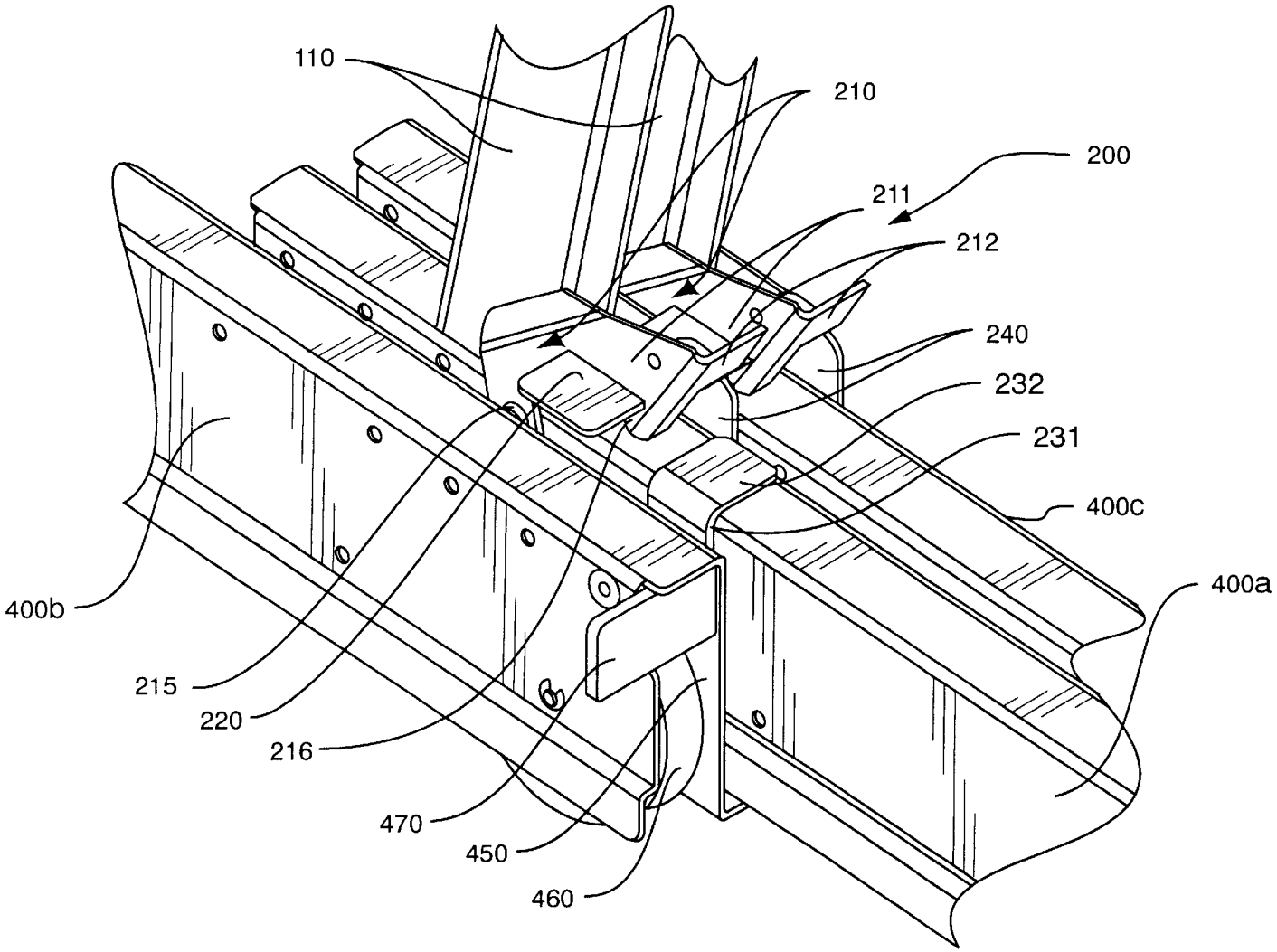
FIG. 16 is a top front perspective view of a castor horn lock assembly according to one embodiment of the invention.
Figure 17:
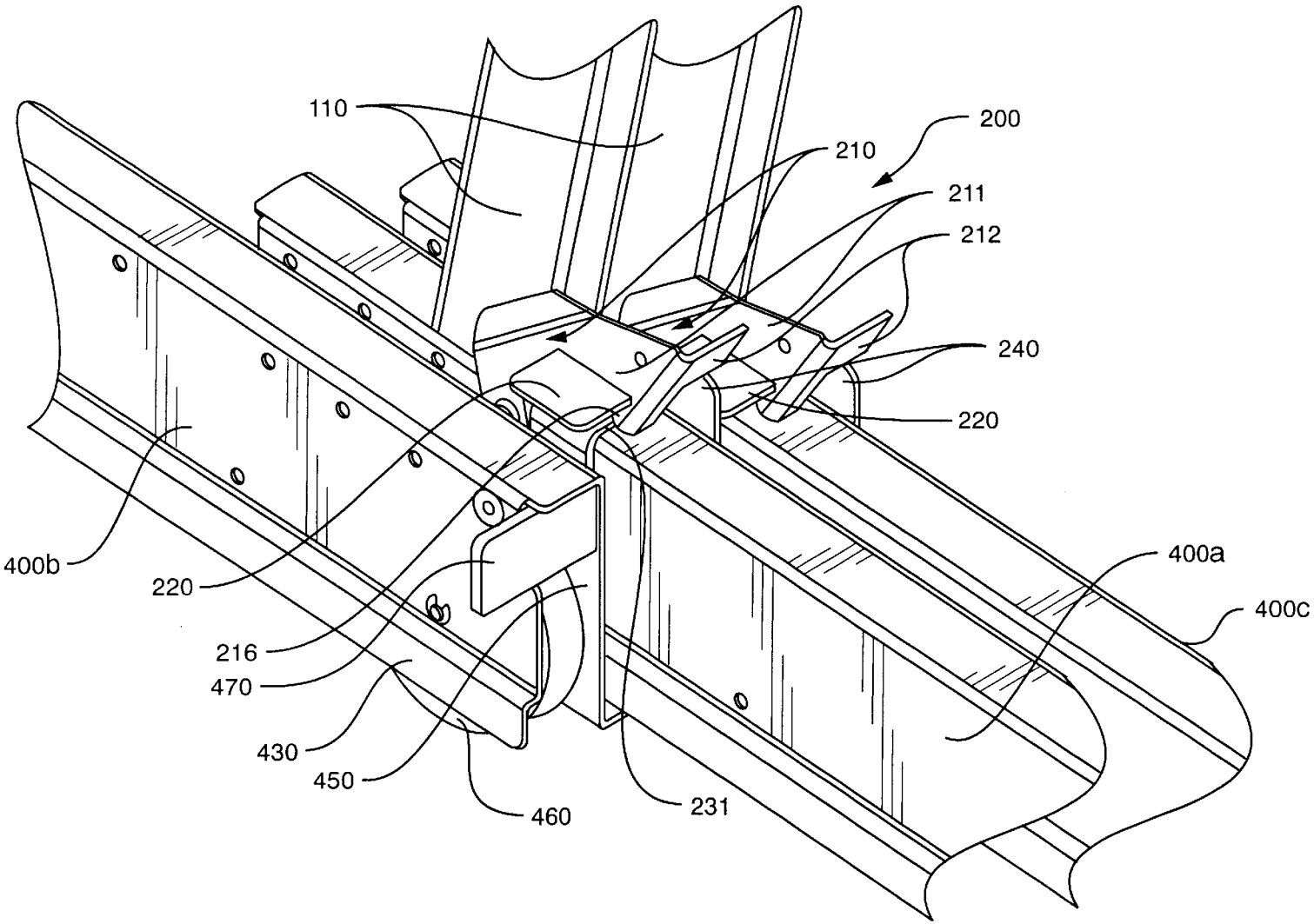
FIG. 17 is a top front perspective view of a castor horn assembly according to one embodiment of the invention.
Figure 18:
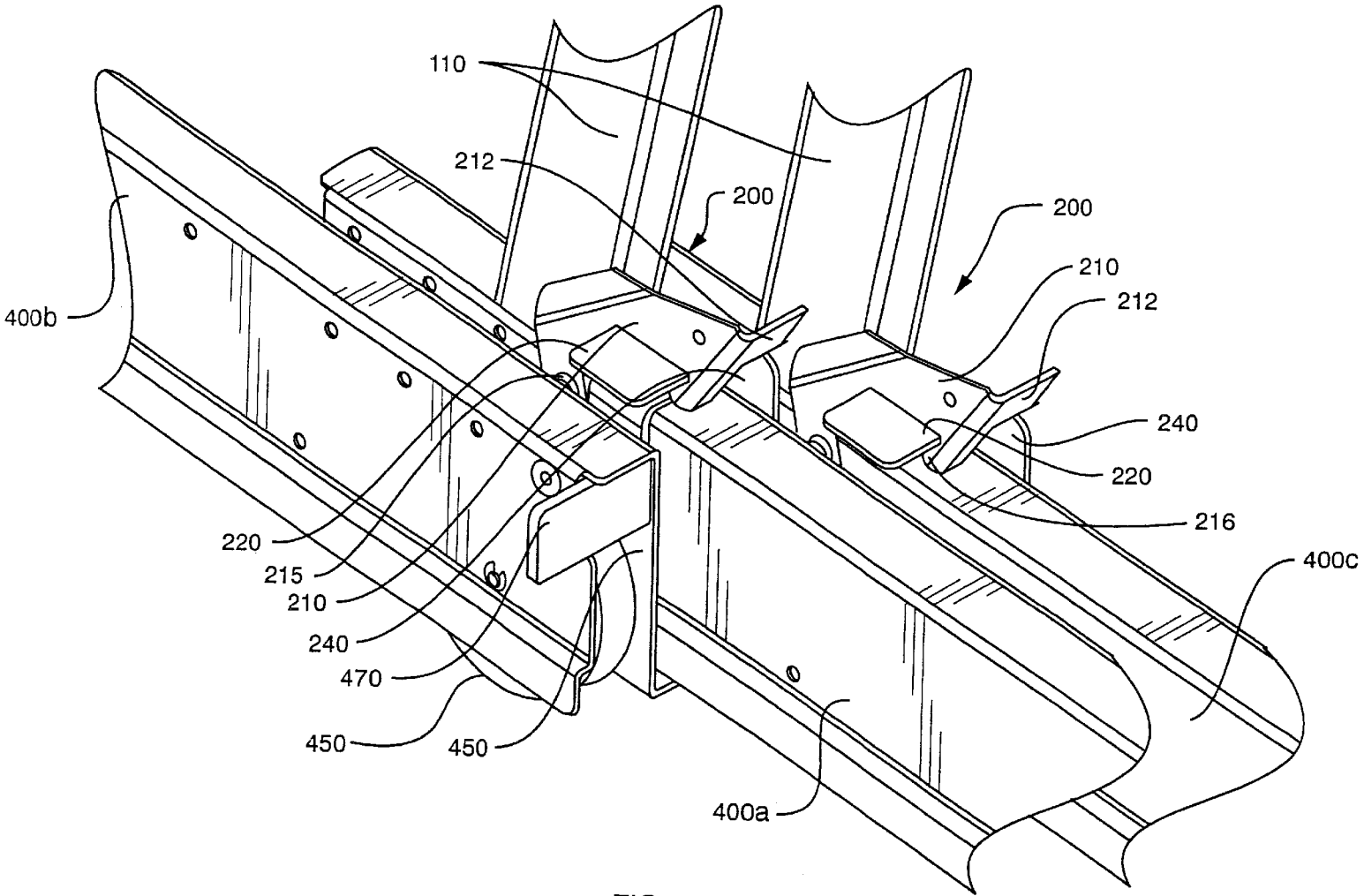
FIG. 18 is a top front perspective view of a castor horn assembly according to one embodiment of the invention.
Figure 19:
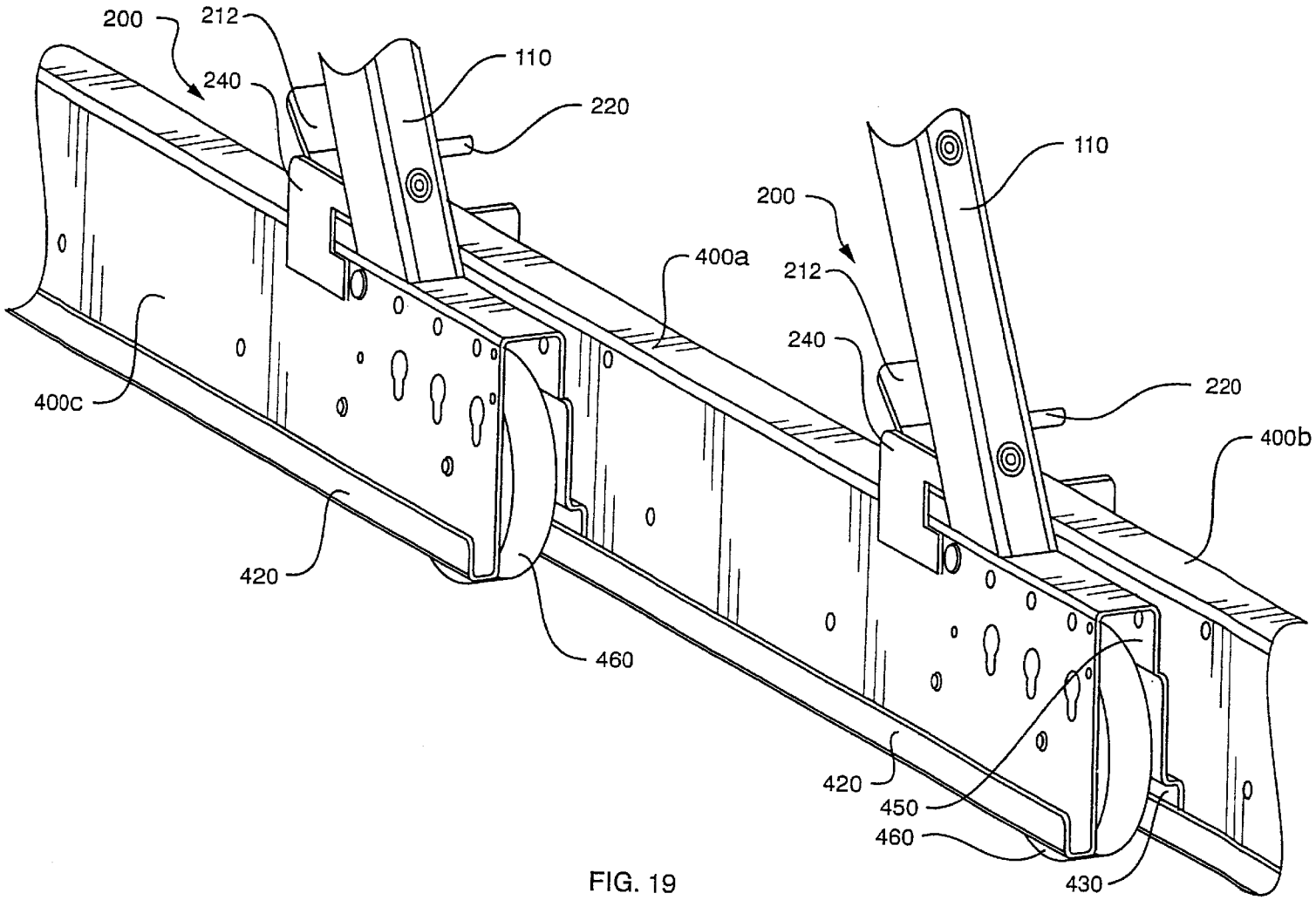
FIG. 19 is a backside perspective view of a castor horn assembly according to one embodiment of the invention.
Figure 23:
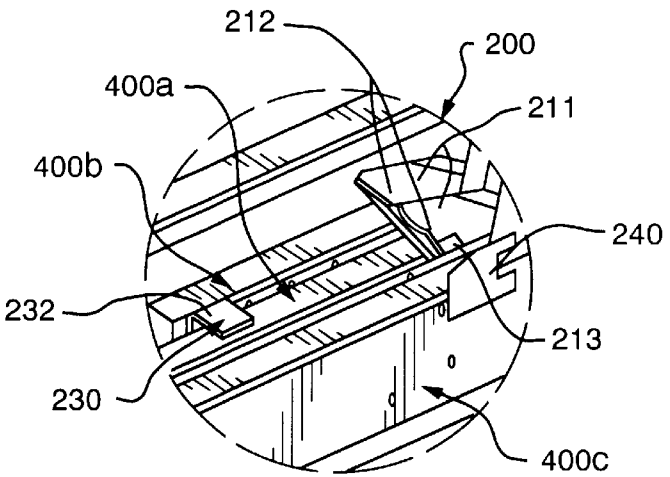
FIG. 23 is a top right perspective view of a castor horn lock assembly in an unlocked, closing position according to one embodiment of the invention.
Figure 21:
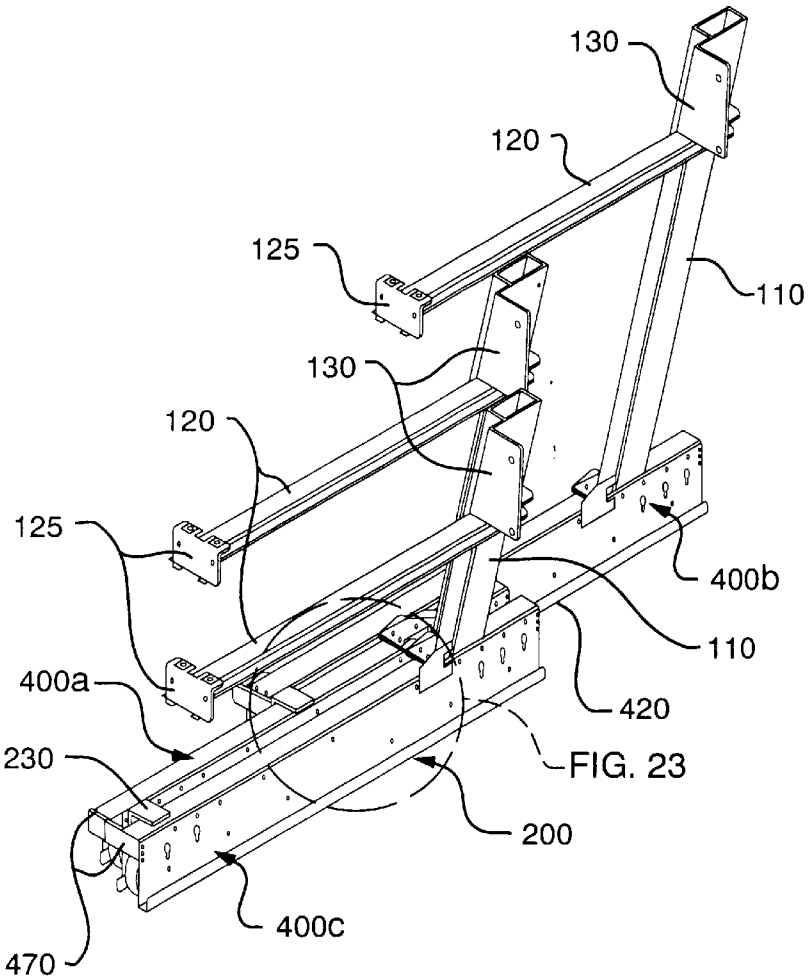
FIG. 21 is a right perspective view of a plural platform assembly in an unlocked, closing position according to one embodiment of the invention.
Figure 24:
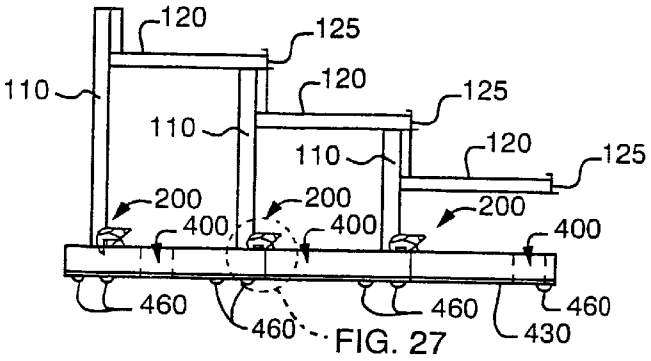
FIG. 24 is a side elevational view of a plural platform support assembly in an extended position according to one embodiment of the invention.
Figure 25:
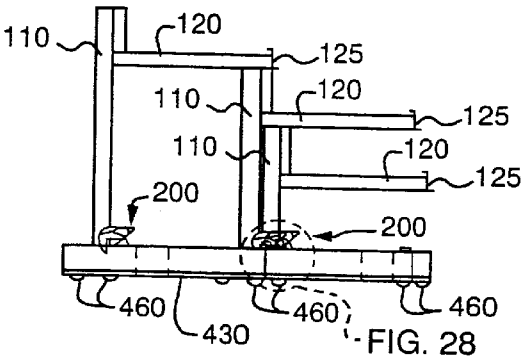
FIG. 25 is a side elevational view of a plural platform support assembly in a partially retracted unlocking position according to one embodiment of the invention.
Figure 26:
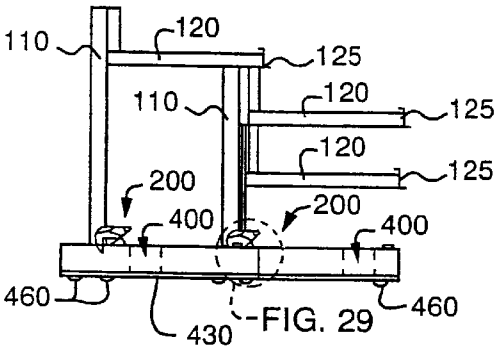
FIG. 26 is a side elevational view of a plural platform support assembly in a retracted unlocked position according to one embodiment of the invention.
Figure 27:
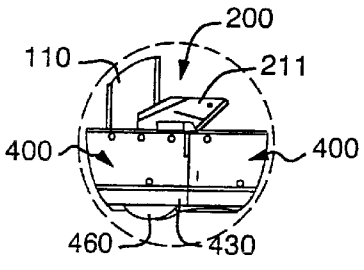
FIG. 27 is a side elevational view of a castor horn lock assembly in a locked position according to one embodiment of the invention.
Figure 28:
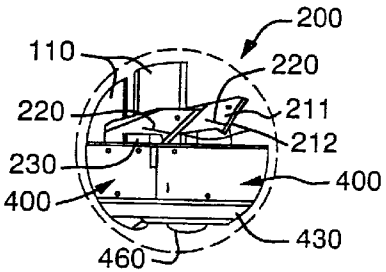
FIG. 28 is a side elevational view of a castor horn lock assembly in a partially unlocked position according to one embodiment of the invention.
Figure 29:
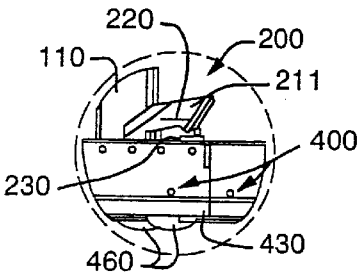
FIG. 29 is a side elevational view of a castor horn lock assembly in an unlocked position according to one embodiment of the invention.

Attached to a first side of caster horn 400 at approximately the location of a front edge of column 110 is tier catch 210. As shown in FIG. 1*a*, tier catch 210 is attached to caster horn 400 with a pin or bolt 215 such that tier catch 210 can freely rotate about pin 215. In a preferred embodiment, tier catch 210 has a threaded nut 222 affixed via welding or other suitable attachment means to a distal arm 221 as shown in FIGS. 40, 41, 43 and 44. Nut 222 preferably has a thick cylindrical outer diameter that is preferably equivalent to the diameter of bolt 215. Such a combination creates two bearing surfaces that eliminates or at least reduces lateral slop and play in tier catch 210. Preferably, Locktite® is added to prevent bolt/nut disengagement. The combination of bolt 215 and nut 222 act as a hinge upon which tier catch 210 pivots. Optionally, washers, preferably nylon, can be placed on bolt 215 between the head of bolt 215 and castor horn 400 and between nut 222 and castor horn 400 to minimize friction and eliminate the need for oiling the rotating surfaces.

Figure 41:
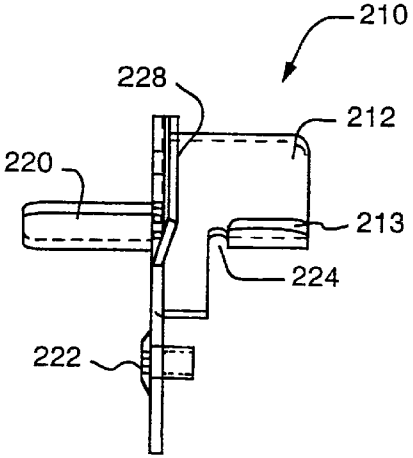
FIG. 41 is a front elevational view of a tier catch according to one embodiment of the invention.
Figure 40:
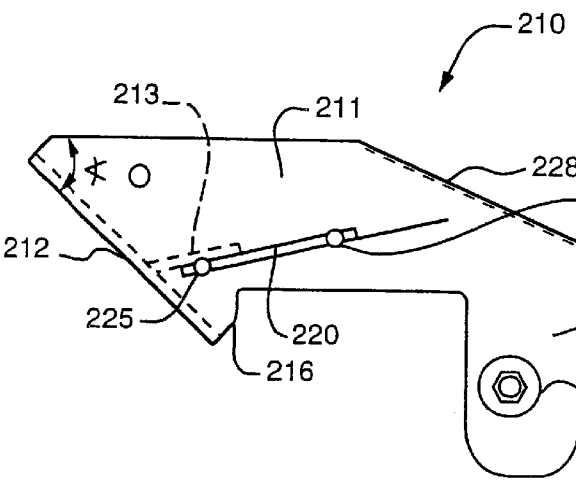
FIG. 40 is a side elevational view of a tier catch according to one embodiment of the invention.
Figure 44:
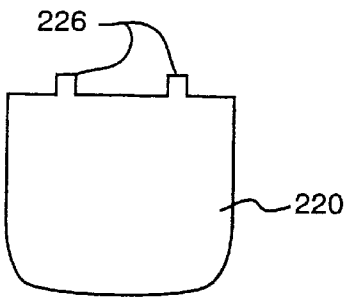
FIG. 44 is a top plan view of a tier catch tab according to one embodiment of the invention.
Figure 43:
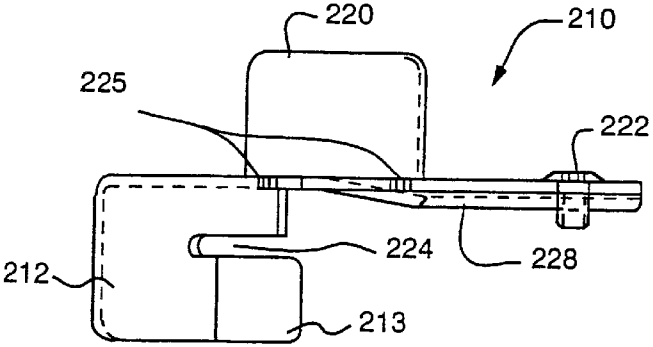
FIG. 43 is a top view of a tier catch according to one embodiment of the invention.

Tier catch 210 has a tier catch body 211 that is a flat piece of steel shaped to form a hook 216 (shown in FIG. 40) that is adapted to engage and releasably lock an end guide 230 of an adjacent caster horn 400 as described in more detail below. Tier catch 210 has a catch release strike plate 212 at a front end of tier catch 210 that is oriented substantially perpendicular to the plane occupied by tier catch body 211. Attached to a side of tier catch body 211 that is opposite the side adjacent to column 110 is tier catch tab 220. Tier catch tab 220 is adapted to contact tier catch 210 on an adjacent caster horn 400 when adjacent platforms are retracted so that tier catch 210 is released from a locked position relative to a third caster horn 400 that has the end guide 230 onto which the subject tier catch 210 was locked. Tier catch tab 220 can be made integral to tier catch 210 in a casting process or welded onto tier catch 210. If welded, tier catch 210 is provided with tab locating holes 225 and catch tab 220 is provided with locating tabs 226 (FIG. 45). Catch tab 220 is preferably oriented at a 90° angle to the plane occupied by tier catch body 211 as shown in FIG. 41.

Tier catch body 211 has a top section 228 that is canted to the side away from catch tab 220. This ensures that tier catch 210 will pass freely by adjacent canted column 110 when rotated into a vertical unlocked position.

Attached to a second side of caster horn 400 is tier catch ramp 240. Tier catch ramp 240 has a sloped section 241 which is adapted to receive and support tier catch 210 when tier catch 210 is modulated from an operable/locked position to an inoperable/unlocked position, i.e., when tier catch 210 is rotated upwardly about pin 215 when adjacent caster horns 400 and their associated decks or platforms are placed in a nested or fully retracted position. Catch release strike plate 212 has a rear flange or trailing edge 213 which is angled from about 7° to about 18° and preferably about 12° from horizontal when tier catch 210 is in a down or locked position. The incline of the angle is opposite that of catch release strike plate 212. Rear flange 213 allows for adjacent catch tiers 210 to nest when in an unlocked or up position, i.e., when the seating system is in a retracted position.

Situated near the front end of caster horn 400 is end guide 230, which is shaped to substantially conform to the shape of a right angle. A first arm 231 of end guide 230 is attached to a second side of caster horn 400 with mechanical fasteners (not shown), which are threaded or placed into one of a series of apertures formed in the second side of caster horn 400. The particular placement of end guide 230 determines the depth of the rows or platforms for a given telescopic seating system. To adjust the depth, end guide 230 is placed into a different selected aperture on the second side of caster horn 400. A second arm 232 of end guide 230 is adapted to be suspended above a top surface of an adjacent caster horn 400.

In order for catch release strike plate 212 to engage and unlock an adjacent tier catch 210 via engagement with tier catch tab 220, the angles to which the contacting surfaces are set must fit within certain ranges in order for the unlocking process to be successfully accomplished. Catch release strike plate 212 has to be angled forward, i.e., canting forward from a bottom end to a top end of strike plate 212, from about 5° to about 20° and preferably from about 10° to about 15°. Tier catch tab 220 must be angled down going from a back end to a front end of tier catch tab 220 from about 5° to about 20° and preferably from about 10° to about 14° and most preferably at about 12°.

To operate lock system 200, the platforms are pulled out from a nested position so that adjacent caster horns 400 slide into an extended position. When the a tier catch 210 of a first castor horn 400*a* is pulled toward the end guide 230 of a second caster horn 400*b*, tier catch 210 of first caster horn 400*a* slides over and engages a front edge of end guide 230 of second caster horn 400*b* which locks the two castor horns together. This, in turn, locks adjacent platforms or decks into a set position.

To unlock the tier catch/end guide assembly, a tier catch tab 220 on tier catch 210 of a third caster horn 440*c* (which is situated on a side of first caster horn 400 that is opposite the side to which second castor horn 400*b* is adjacent), contacts strike plate 212 on tier catch 210 of first caster horn 400*a* when third caster horn 400*c* is slid toward a retracted or nested position. Tier catch 210 of first caster horn 400*a* is rotated upwardly about pin 215 so that hook 216 is disengaged from end guide 230 of second caster horn 400*b*.

Utilization of this system of tier catches, end guides and release strike plates eliminates the need for trip bars as used in conventional systems. The lock system of the present invention also eliminates the need for external devices to operate the trip bars.

Figure 31:
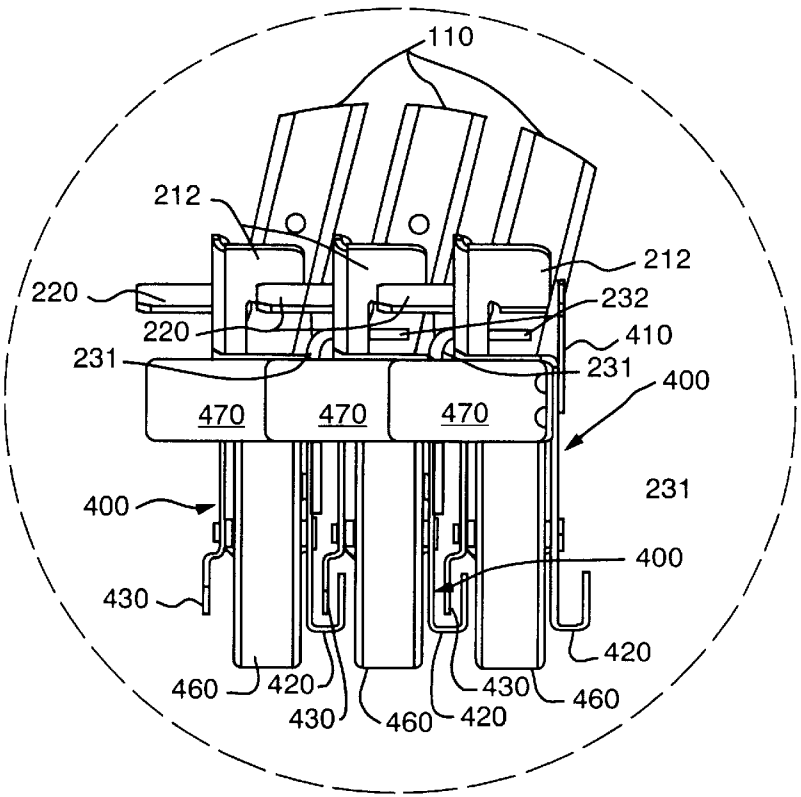
FIG. 31 is a front elevational view of a plural castor horn assemblage in a locked position according to one embodiment of the invention.
Figure 30:
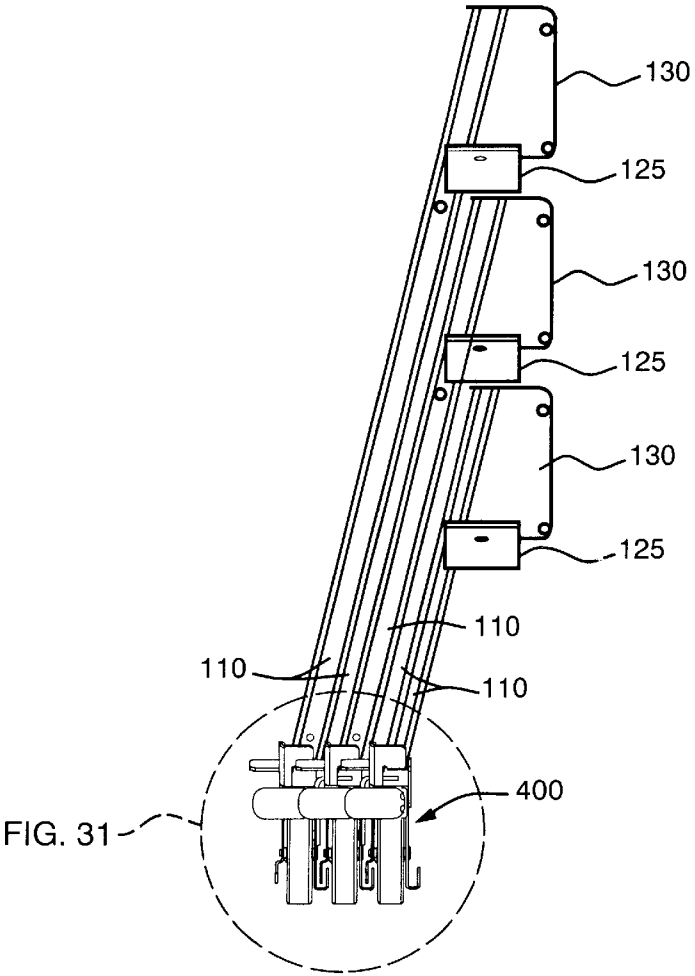
FIG. 30 is a front elevational view of a plural platform support assembly in a locked position according to one embodiment of the invention.
Figure 32:
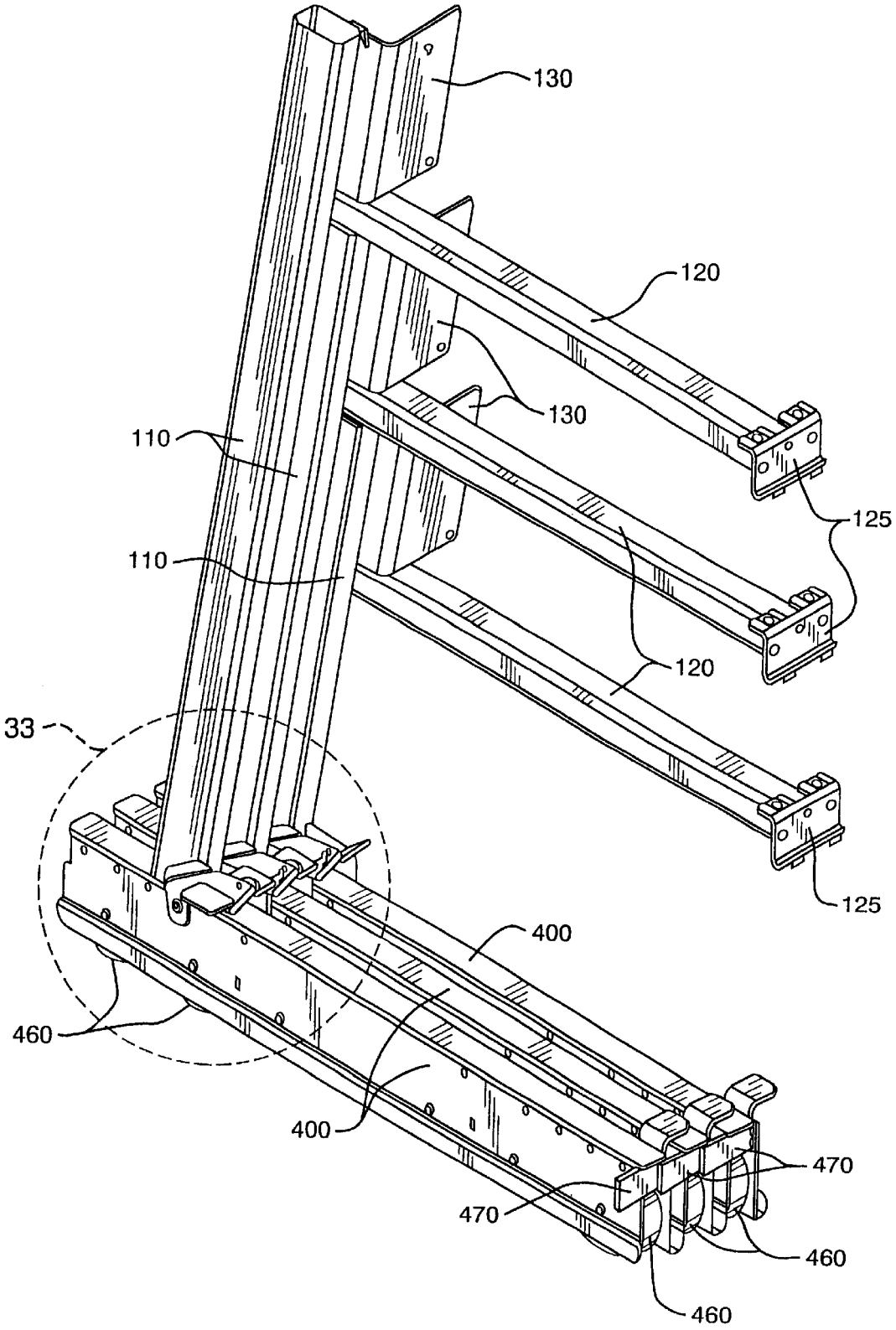
FIG. 32 is a side perspective view of a plural platform support assembly in a retracted unlocked position according to one embodiment of the invention.
Figure 33:
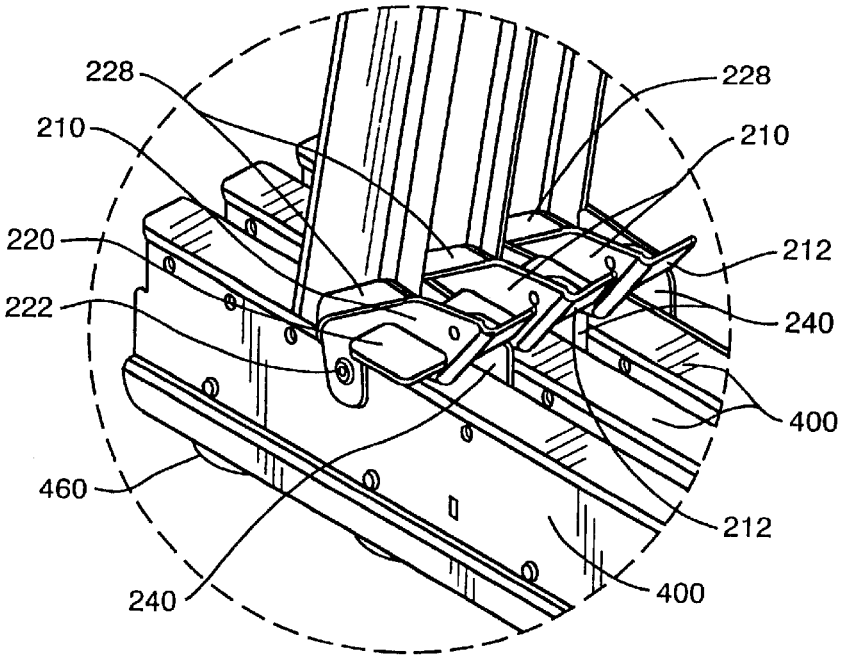
FIG. 33 is a side perspective view of a castor horn and castor horn lock assemblage in a retracted unlocked position according to one embodiment of the invention.
Figure 35:
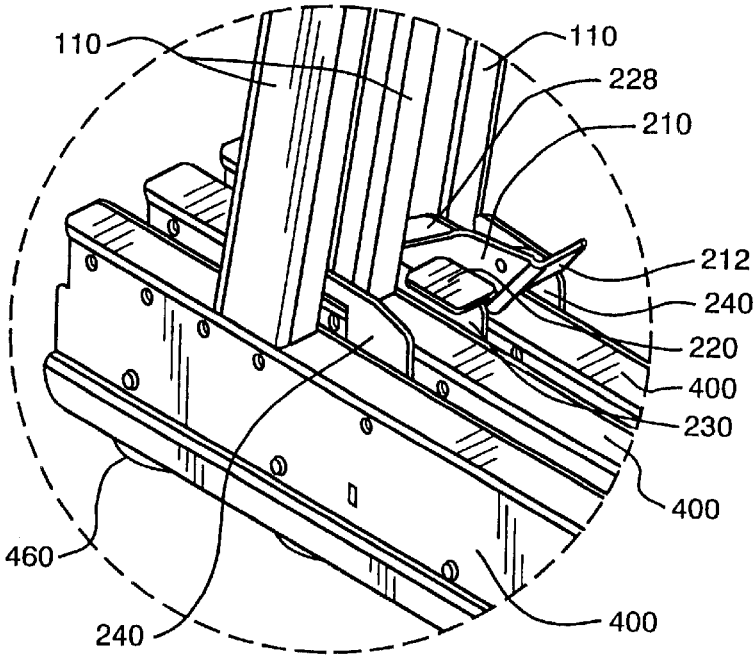
FIG. 35 is a side perspective view of a castor horn and castor horrn lock assemblage according to one embodiment of the invention.
Figure 34:
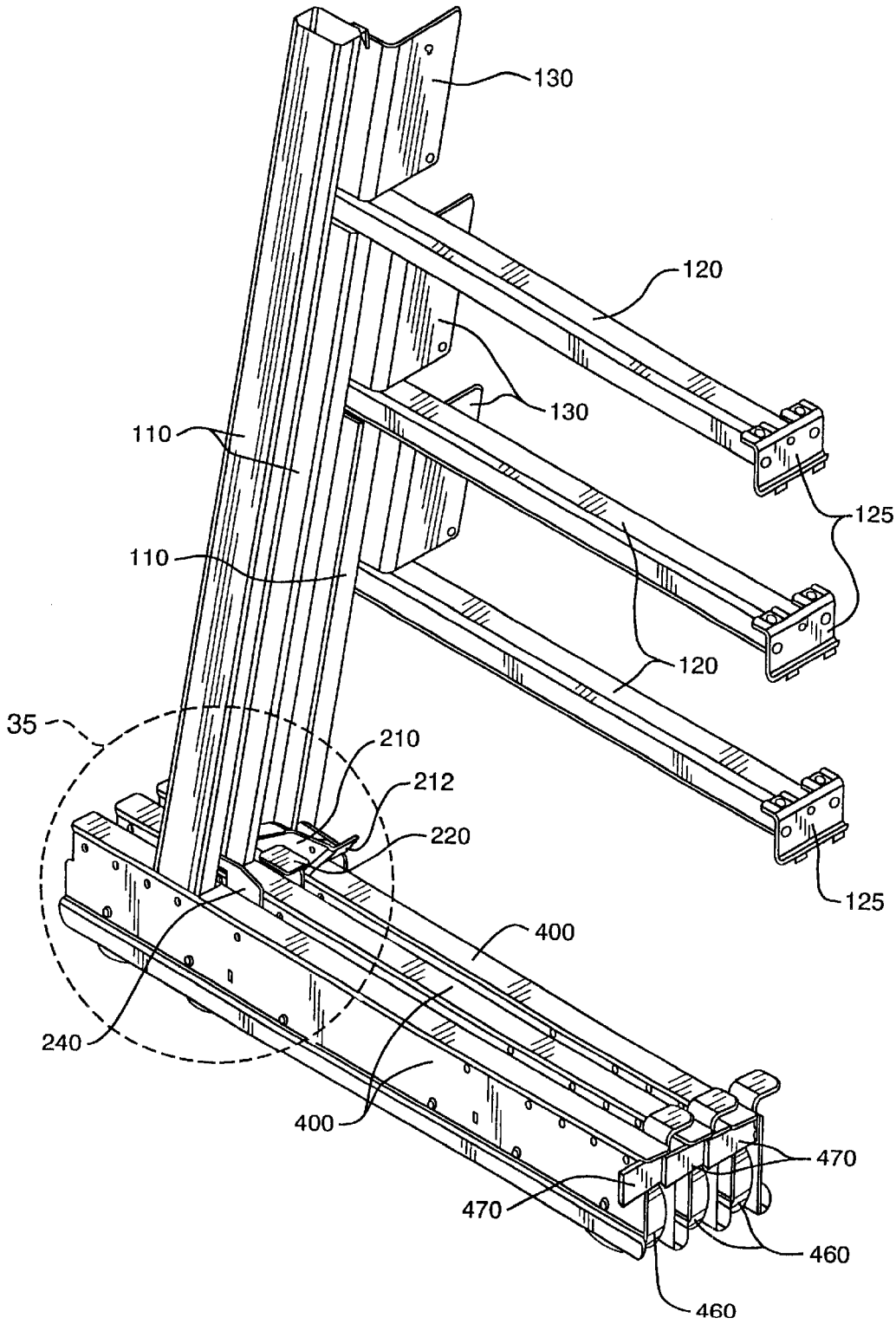
FIG. 34 is a right side perspective view of a plural platform support assembly in a nested and unlocked position according to one embodiment of the invention.
Figure 37:
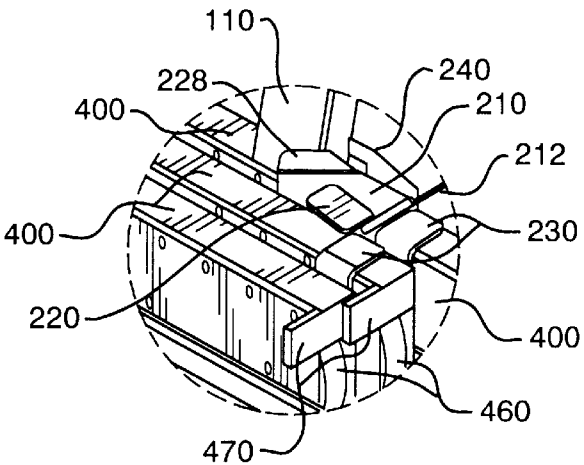
FIG. 37 is a topside perspective view of a castor horn and castor horn lock assemblage in a partially retracted, unlocked position according to one embodiment of the invention.
Figure 36:
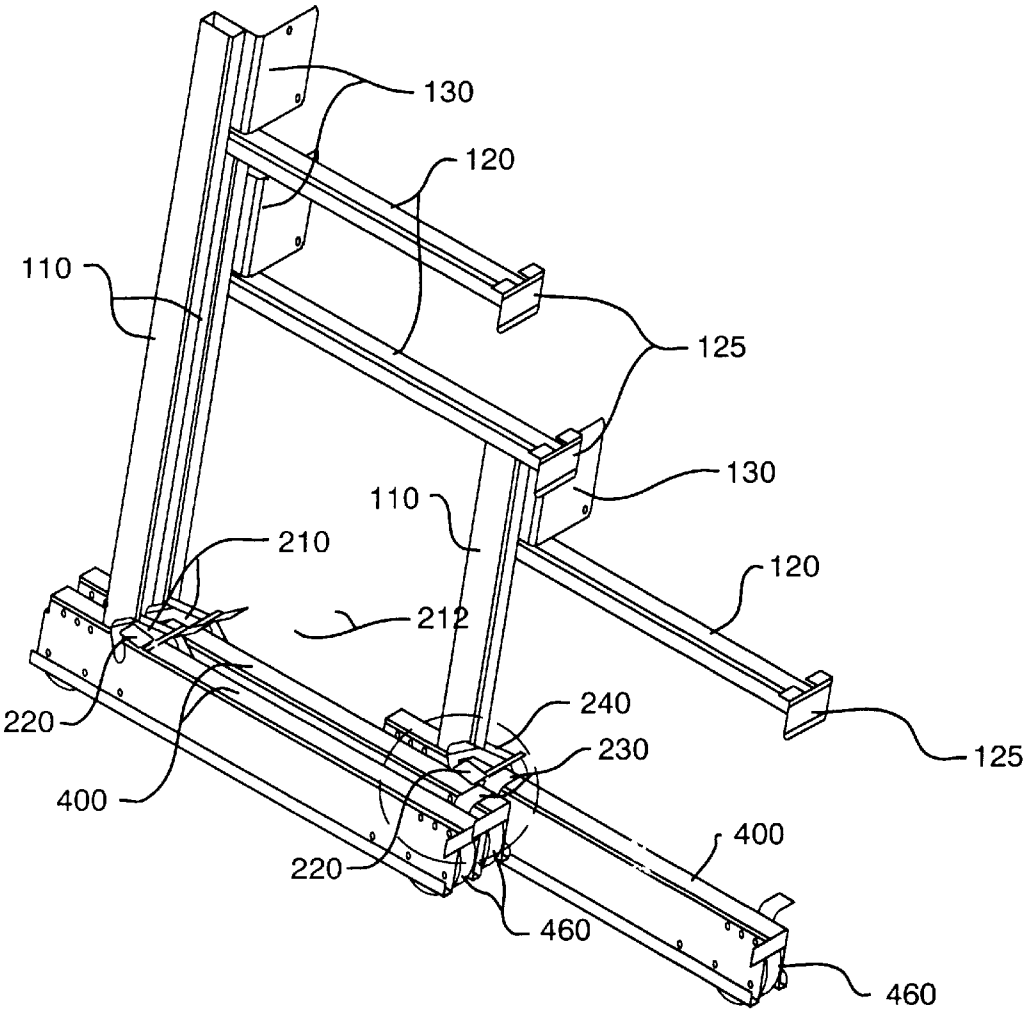
FIG. 36 is a side perspective view of a plural platform support assembly in a partially retracted, unlocked position according to one embodiment of the invention.
Figure 39:
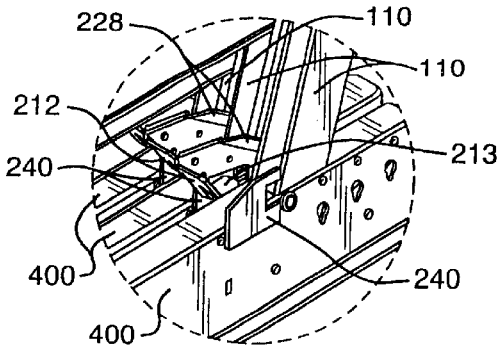
FIG. 39 is a left side perspective view of a castor horn and castor horn lock assemblage in a retracted unlocked position according to one embodiment of the invention.
Figure 38:
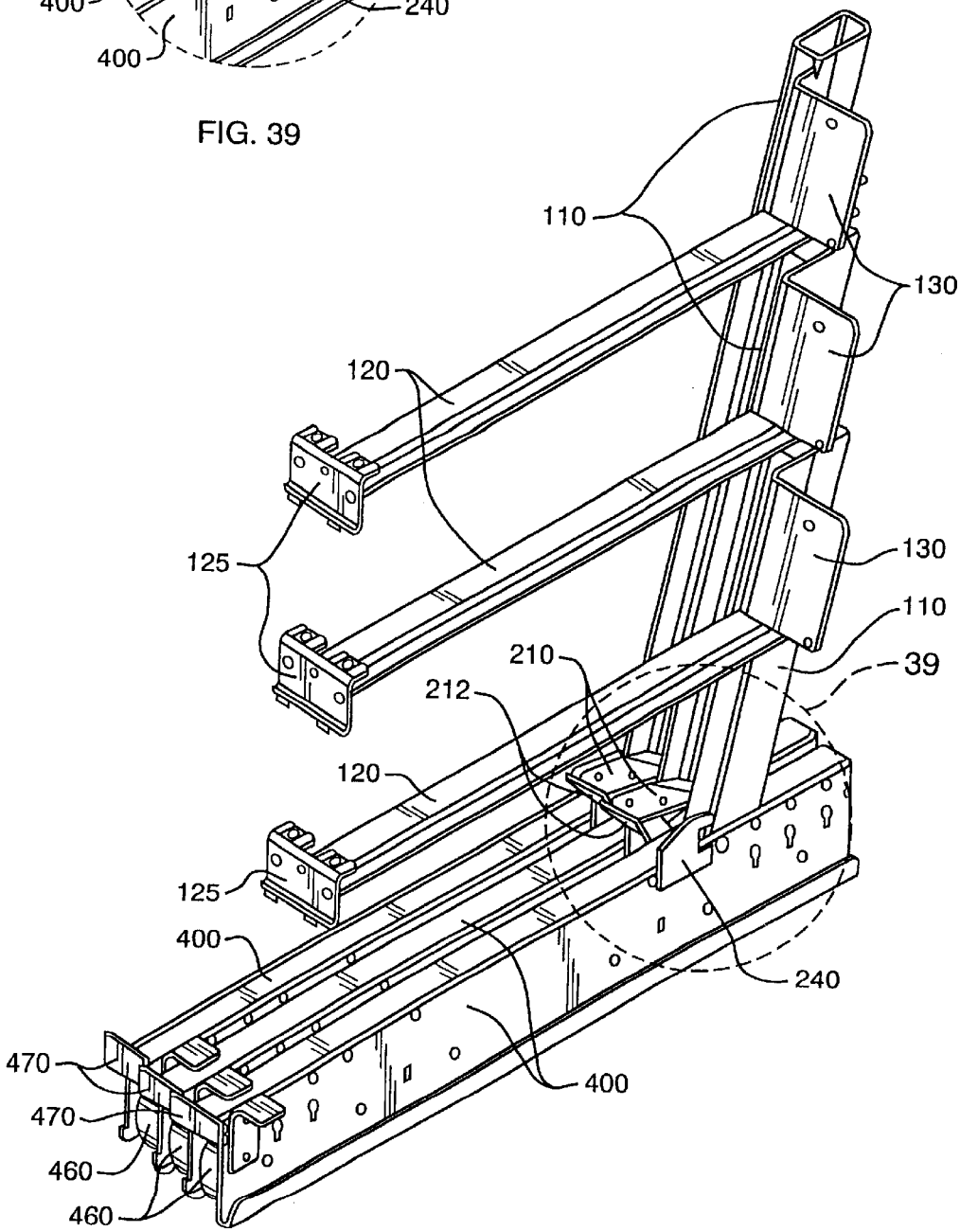
FIG. 38 is a left side perspective view of a plural platform support assembly in a retracted and unlocked position according to one embodiment of the invention.
Figure 42:
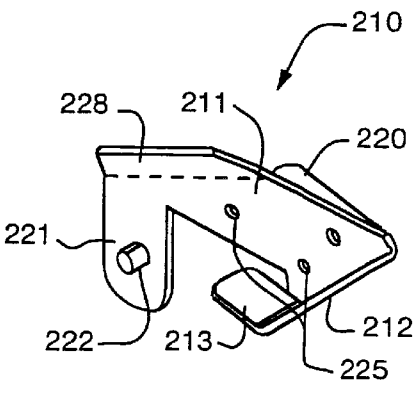
FIG. 42 is a side perspective view of a tier catch according to one embodiment of the invention.

Turning to FIG. 30 and 31, a plurality of assembled caster horns are shown. Referring specifically to FIG. 30, a plurality of caster horns 400 are shown attached to columns 110 which each have a riser support plate 130 and nose plates 125 as previously described. Referring specifically to FIG. 31, caster horns 400 have caster horn bodies 410 which has portions defining a J-hook 420 on a first side of caster horn body 410, which preferably extends along the entire length of caster horn body 410. J-hook 420 forms a channel for receiving a knee hook 430 of an adjacent caster horn 400.

Caster horn body 410 has further portions, which define knee hook 430 on a second side of castor horn body 410, which preferably extends along the entire length of castor horn body 410. Knee hook 430 can extend as little as 10% of the length of castor horn body 410. However, to provide maximum support for castor horn alignment, knee hook 430 has to extend the entire length of caster horn body 410.

J-hook 420 and knee hook 430 are adapted to mate in sliding engagement. To assemble or interlock castor horns, the J-hook 420 of one caster horn 400 is mated with the knee hook 430 of an adjacent caster horn 400 by either placing knee hook 430 into the channel formed by J-hook 420 or by sliding one into the other from the ends of the caster horns 400. The mating surfaces ensure that adjacent caster horns 400 are maintained in a parallel orientation when a telescopic seating system is in any position between full retraction and full extension. Fully interlocked castor horns which have J-hooks 420 and knee hooks 430 that run the entire length of the castor horn bodies 410 provide maximum resistance to the pivotal movement of individual castor horns from a parallel orientation that is caused by the lateral movement of columns 200 when under load. Unlike prior art systems, the fully interlocked caster horns 400 of the present invention resist castor horn pivotal travel at all possible positions of telescopic seating system retraction and extension.

Having described the invention it should be understood that the foregoing description of the invention is intended merely to be illustrative thereof and that other modifications, embodiments and equivalents may be apparent to those who are skilled in the art without departing from its spirit.

I claim:

1. A telescopic seating system comprising:

a first row comprising at least two modular row units wherein the row units each comprise:

a first row rear riser beam having a flange extending from a front surface thereof for receiving platform sheathing;

a first row nose beam having a flange extending from a back surface thereof for receiving platform sheathing;

at least one deck stabilizer for connecting the first row riser beam and first row nose beam, the at least one deck stabilizer having a channel formed therein and adapted to receive roller wheels;

a plurality of roller wheels connected in rotational movement to the at least one deck stabilizer; and, platform sheathing placed upon the riser beam flange and the nose beam flange for receiving loads; and, a second row comprising a second row rear riser beam having a flange extending from a front surface thereof;

a second row nose beam having a flange extending from a back surface thereof for receiving platform sheathing;

at least one second row deck stabilizer for connecting the second row riser beam and second row nose beam;

at least two caster horns having caster horn channels formed therein and adapted to receive roller wheels;

at least two columns attached to the at least two caster horns and to the second row riser beam for elevating the second row to a selected height;

second row platform sheathing placed upon the riser beam flange and the nose beam flange for receiving loads a tier catch attached to at least one castor horn, and a tier catch ramp attached to at least one castor horn.

2. A telescopic seating system comprising:

at least one platform having a frame;

a caster horn having a first and second side attached to the frame;

a tier catch rotatably attached to the first side of the caster horn; and a tier catch ramp attached to a second side of the caster horn.

3. The seating system of claim 2 further comprising wheels rotatably attached in the caster horn.

4. The seating system of claim 2 further comprising a column attached between the frame and the caster horn.

5. The seating system of claim 4 further comprising a column cantilever having proximal and distal ends wherein the proximal end is attached to the column and the distal end and portions adjacent the distal end are attached to a bottom of the at least one platform row.

6. The seating system of claim 5 wherein the cantilever has portions defining a race and the column further comprises a column wheel rotatably attached to a top end of the column.

7. The seating system of claim 2 wherein the frame comprises a rear riser beam and a front nose beam.

8. The seating system of claim 7 wherein the frame further comprises at least one deck stabilizer connecting the rear riser beam to the front nose beam.

9. The seating system of claim 8 wherein the nose beam and the rear riser beams have portions defining flanges.

10. The seating system of claim 9 further comprising decking material positioned on the nose beam and rear riser beam flanges.

11. The seating system of claim 2 wherein the tier catch comprises a tier catch body having a top surface, bottom surface, front end, back end, first side and second side and portions forming a hook on the bottom surface proximal to the front end.

12. The seating system of claim 11 wherein the tier catch further comprises a distal arm extending downwardly from the back end of the tier catch body.

13. The seating system of claim 12 wherein the distal arm has portions defining a bore for receiving a mechanical fastener used to secure the tier catch to the caster horn.

14. The seating system of claim 13 wherein the tier catch further comprises a strike plate extending laterally from a first side of the tier catch body.

15. The seating system of claim 14 wherein the strike plate forms an acute angle with the plane occupied by the top surface of the tier catch body.

16. The seating system of claim 15 wherein the strike plate comprises a rear flange extending distally from a bottom end of the strike plate.

17. The seating system of claim 16 wherein the tier catch further comprises a tier catch tab extending laterally from a second side of the tier catch body.

18. The seating system of claim 17 wherein a distal portion of the top surface of the tier catch body slants downwardly from the plane occupied by the top surface of the tier catch body.

19. The seating system of claim 18 wherein the tier catch body further comprises a top flange extending laterally from the top surface distal portion on the second side of the tier catch body.

20. A method of securing a telescopic seating system comprising the steps of providing a plurality of engaged platforms, each platform having a caster horn with a tier catch and a tier catch ramp; and engaging the tier catch of a first platform with the tier catch of the second platform.

* * * * *